US007137513B2

(12) United States Patent
Sedon et al.

(10) Patent No.: US 7,137,513 B2
(45) Date of Patent: Nov. 21, 2006

(54) MERCHANDISE DISPLAY SYSTEM

(75) Inventors: Nicholas M. Sedon, Weddington, NC (US); Richard E. Corney, Akron, OH (US)

(73) Assignee: Alpha Security Products, Inc., Charlotte, NC (US)

( * ) Notice: Subject to any disclaimer, the term of this patent is extended or adjusted under 35 U.S.C. 154(b) by 236 days.

(21) Appl. No.: 10/754,211

(22) Filed: Jan. 9, 2004
(Under 37 CFR 1.47)

(65) Prior Publication Data

US 2004/0182801 A1 Sep. 23, 2004

Related U.S. Application Data

(60) Provisional application No. 60/441,097, filed on Jan. 17, 2003.

(51) Int. Cl.
*A47F 5/08* (2006.01)

(52) U.S. Cl. ..... 211/59.1; 211/7; 211/116; 248/288.31

(58) Field of Classification Search ..... 211/40, 211/97, 115; 248/288.31, 317, 324; 403/56, 403/122

See application file for complete search history.

(56) References Cited

U.S. PATENT DOCUMENTS

| | | | | | |
|---|---|---|---|---|---|
| 1,628,973 | A | * | 5/1927 | Harley | 482/87 |
| 2,739,780 | A | * | 3/1956 | Richards | 248/324 |
| 3,302,917 | A | * | 2/1967 | Winkler | 248/317 |
| 3,495,716 | A | | 2/1970 | Gregory | |
| 3,750,995 | A | * | 8/1973 | Genger | 248/324 |
| 3,786,927 | A | | 1/1974 | Manheim | |
| 4,832,301 | A | * | 5/1989 | Hiramoto et al. | 248/691 |
| D343,356 | S | * | 1/1994 | Wittman | D9/415 |
| 5,344,028 | A | | 9/1994 | Angele | |
| D352,222 | S | * | 11/1994 | Fredrickson | D8/331 |
| D362,802 | S | * | 10/1995 | Lee | D9/423 |
| 5,478,039 | A | * | 12/1995 | Wright | 248/341 |
| 5,509,528 | A | * | 4/1996 | Weisburn | 206/45.24 |
| 5,860,712 | A | | 1/1999 | Nielsen | |
| 6,125,668 | A | | 10/2000 | Belden, Jr. | |

(Continued)

FOREIGN PATENT DOCUMENTS

| | | |
|---|---|---|
| FR | 2 606 985 | 5/1988 |

(Continued)

OTHER PUBLICATIONS

GB0401006.2 Search Report, Jul. 9, 2004.

*Primary Examiner*—Richard E. Chilcot, Jr.
*Assistant Examiner*—Jared W. Newton
(74) *Attorney, Agent, or Firm*—Sand & Sebolt

(57) ABSTRACT

A merchandise display system includes a rod lockably connected to a peg board, a hanging member hanging from the rod and a swivel member rotatably connected to the hanging member about a first axis. The swivel member is connected to a lockable display case for carrying an item of merchandise and is rotatable about a second axis perpendicular to the first axis. Thus, the display case is rotatable about the first and second axes to facilitate viewing the merchandise from any angle while the case is lockably connected to the rod. The hanging and swivel members may be a ball and socket combination. Alternately, the swivel member may connect to the display case via a hinge pin about which portions of the case may rotate to open and close. Alternately, a lower member may extend from within the case through holes therein to rotatably connect to the swivel member about the second axis.

23 Claims, 25 Drawing Sheets

U.S. PATENT DOCUMENTS 6,357,711 B1 * 3/2002 Heyderman et al. ... 248/288.31
6,474,478 B1 * 11/2002 Huehner et al. ..... 211/4
6,571,944 B1 * 6/2003 Ku ..... 206/308.1
6,622,979 B1 * 9/2003 Valiulis ..... 248/220.42
6,637,589 B1 10/2003 Broadhead
6,659,291 B1 * 12/2003 Huehner et al. ..... 211/4
6,915,996 B1 * 7/2005 Lin ..... 248/288.51
6,938,865 B1 * 9/2005 Day ..... 248/229.14
6,966,438 B1 * 11/2005 Belden et al. ..... 206/308.1
7,007,810 B1 * 3/2006 Huehner et al. ..... 211/57.1
2004/0026344 A1 * 2/2004 Sedon et al. ..... 211/7
2004/0262474 A1 * 12/2004 Boks et al. ..... 248/276.1
2005/0151040 A1 * 7/2005 Hsu ..... 248/214
2005/0279894 A1 * 12/2005 Sedon et al. ..... 248/175

FOREIGN PATENT DOCUMENTS

WO WO 92/03823 3/1992

* cited by examiner

MERCHANDISE DISPLAY SYSTEM

CROSS REFERENCE TO RELATED APPLICATIONS

This application claims priority from U.S. Provisional Patent Application Ser. 60/441,097 filed Jan. 17, 2003; the disclosures of which are incorporated herein by reference.

BACKGROUND OF THE INVENTION

1. Technical Field

The invention relates generally to merchandise display systems. More particularly, the invention relates to a merchandise display system that is lockable to prevent the merchandise from being removed. Specifically, the invention relates to such a system wherein merchandise can be handled and viewed by the consumer while remaining locked to thwart shoplifting.

2. Background Information

In seeking out products to buy, consumers have a natural desire to be able to handle and view the products for making their purchase. However, vendors naturally have a concern that products will be stolen. As a result, vendors desire merchandise displays which are lockable to prevent such theft. The problem that arises is that merchandise display assemblies do not generally allow the consumer to easily handle and view products without the merchandise assembly being unlocked first.

Thus, the art needs a merchandise assembly which is both lockable to prevent theft and also allows the consumer to easily handle and view the product without the need for the vendor to unlock the display assembly until the consumer has already made the decision to purchase the product. The merchandise display assembly of the present invention solves this problem by allowing merchandise to hang from a display rod by a hanging assembly which allows the merchandise to pivot and swivel freely such that the consumer can handle the product and see it from nearly every angle.

U.S. Pat. No. 3,495,716 to Gregory discloses a stereo tape display holder which includes a lockable case to hold the tape, the case having openings in an end wall and side walls thereof through which printed data on the tape may be viewed. A swivel means includes a first annular link coaxially connected to a boss on the case by a bolt or rivet and a second annular link rotatably connected to the first link by a rivet. The second link encircles a rod of a wire display rack sitting atop a display cabinet. The swivel means allows rotation about an axis so that the lockable case is rotatable about said axis with respect to the second link. The rod is freely received by the second link so that the second link may easily slide along and rotate about the rod. This configuration allows the lockable case to be lifted upwardly from the display rack in pivoting relation to the rod and rotated about the axis to facilitate viewing by a consumer.

The configurations disclosed in the Gregory patent leave a variety of areas for improvement. First, the Gregory swivel means rotates about only one axis, so that the swivel means and case must rotate about the rod to allow rotation about a second axis. Applicants' invention, by contrast, includes a swivel which itself allows rotation about first and second axes perpendicular to one another. Thus, Applicants' swivel assembly enhances the ability to maneuver the display case as desired.

Further, the first link of Gregory's swivel means is connected to the display case by a bolt or rivet and the first and second links are attached by a rivet, thus making the case and swivel inseparable, whereas Applicants' invention provides a variety of options whereby the use of a rivet and the like is eliminated and portions of the swivel assembly are separable from one another to allow removal of the display case from the rod assembly. Applicants' ball and socket arrangement requires only two pieces and still provides the additional rotational capability in comparison to the four or more pieces of Gregory's swivel means. The ball and socket configuration provides this simplicity by connecting to the case by a snap fit engagement and linking the two pieces together by interference engagement, thus eliminating separate fasteners. The hinge pin embodiment provides multiple tasking by the hinge pin so that the swivel assembly connects to the case via the hinge pin, rotation about the hinge pin is coaxial with the second axis, and rotation of the display case lid and base occurs about the hinge pin to open and close the display case. Applicants' embodiment using a hanging member, a swivel member and a lower member eliminates need for a boss on the display case, provides a simple snap fit engagement between the hanging and swivel members and provides a snap fit engagement between the swivel and lower members with the latter snap fit providing rotation about the second axis. The various snap fit engagements facilitate assembly of the swivel assembly and the connection to the display case.

As noted above, the Gregory swivel means is configured to be unremovable from the display case and does not permit the display case to be removed from the display rack. Applicants' invention, by contrast, provides a swivel assembly with separable elements which permit the display case to be removed from the rod assembly without unlocking the rod assembly from the support structure, such as a peg board. Thus, after a customer has viewed the item of merchandise while still connected to the rod assembly, a store employee may then easily unlock the display case from the rod assembly to allow purchase of the item. One advantage of this configuration is that the item display case may be removed from the rod assembly without separating the rod assembly from the support structure. Another advantage is that the item may remain in the case until immediately prior to purchase at the cash register, thus providing at least a visual indicator to store or security personnel that the item has not yet been purchased. Additionally, an electronic article surveillance tag may be connected to the display case as opposed to the merchandise, so that an alarm may sound while the item is in the case, but not after it is removed from the lockable display case.

Because Gregory does not include the separable elements noted above, the Gregory device does not need a corresponding locking mechanism. Gregory does disclose locking mechanisms for locking the display case, namely a padlock and a lock with a slidable plunger, but these are standard locks operable with a standard key. Applicants' locking mechanism for holding the separable elements together may be magnetically unlockable and invisible to the eye of a potential thief. The invisibility may prevent a thief from even recognizing that there are separable elements. In addition, the same key may be used for the lock used with the separable elements, the lock used to lock the rod assembly to the support structure and the lock used with the end assembly.

Further, the wire rack display and display cabinet of Gregory have several limitations. First, Gregory's wire display rack is bulky and cumbersome even if not attached to the display cabinet. When attached atop the boxlike display cabinet, the display support structure is particularly cumbersome if not stationary and certainly consumes a great deal of space. In addition, the wire rack is configured in a shelf-like fashion whereby the display cases rest upon one or more wires while attached via the swivel means to the rod.

By contrast, Applicants' rod assemblies are simple and compact, and are thus easily manufactured at a relatively low cost and consume far less precious floor space. Applicants' rod assemblies are easily attachable to support structures such as peg boards and are lockable to such structures to prevent the entire rod assembly and merchandise from being rapidly removed. Rod assemblies are provided which either attach at both ends to the support structure (including the U-shaped embodiment) or include an end assembly, each option configured to prevent unauthorized removal of merchandise from the rod assemblies while permitting easy loading of merchandise thereon. In addition, Applicants' rod assemblies are easily movable and are removable from the support structure to allow reuse of the rod assemblies elsewhere and facilitate reorganization upon the support structure as needed.

Gregory's display case uses walls having openings therein to permit a consumer to view printed material on the merchandise stored therein. Gregory's case also provides a partition wall spaced from one of the walls, the partition wall intended to make the case fit a smaller item of merchandise and being removable in a breakaway fashion to allow the case to fit a larger item. Applicants' display case fully encloses an item of merchandise, thus providing better protection from vandalism and accommodating a variety of sizes of items to be displayed therein without the need for such a partition wall. In addition, Applicants' transparent case offers visibility from all sides without concern for creating wall openings, which must be particularly sized to securely retain the merchandise and simultaneously allow visibility of pertinent indicia on the merchandise.

BRIEF SUMMARY OF THE INVENTION

The invention generally provides a system for securely displaying merchandise in a manner that allows customers to handle and view the merchandise without removing the merchandise from a display case. The invention provides different interchangeable display configurations that allow a customer to handle, pivot, and rotate a secured item of merchandise.

In one embodiment, the present invention provides a merchandise display system that includes a display structure; a swivel assembly rotatable about a first axis and rotatable about a second axis substantially perpendicular to the first axis; the swivel assembly adapted to be connected to the display structure; and a display case adapted to carry an item of merchandise; the display case being connected to the swivel assembly so that the display case is rotatable about the first and second axes.

In another embodiment, the present invention provides a merchandise display system that includes a display structure; a first member and a swivel member rotatably connected to the first member about a first axis; the first member being adapted to be connected to the display structure; a display case having a pair of members selectively lockable to one another and being adapted to carry an item of merchandise; and at least one hinge pin having a longitudinal second axis substantially perpendicular to the first axis and rotatably connecting the swivel member to the display case about the second axis so that the display case is rotatable about the first and second axes; the at least one hinge pin rotatably connecting the display case members to one another about the second axis whereby the display case members are rotatably movable between open and closed positions when unlocked.

In another embodiment, the present invention provides a merchandise display system having a display structure; a first member, a swivel member and a U-shaped lower member having a pair of legs extending from an intervening base; the swivel member being rotatably connected to the first member about a first axis by a snap fit engagement; the first member being adapted to be connected to the display structure; a display case adapted to carry an item of merchandise; the display case defining a pair of spaced holes on one end thereof and being lockable to selectively retain or release the item of merchandise; and the lower member base being disposed within the display case and the lower member legs respectively extending through the holes in the display case so that the lower member supports the display case and the lower member legs rotatably connect the lower member to the swivel member by a snap fit engagement about a second axis substantially perpendicular to the first axis so that the display case is rotatable about the first and second axes.

The invention also provides an embodiment wherein a display rod is locked at both of its ends to a display structure. The display rod is adapted to carry items of merchandise.

The invention also provides an embodiment wherein a connector is snap fit to a display case in a one-way snap fit connection.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
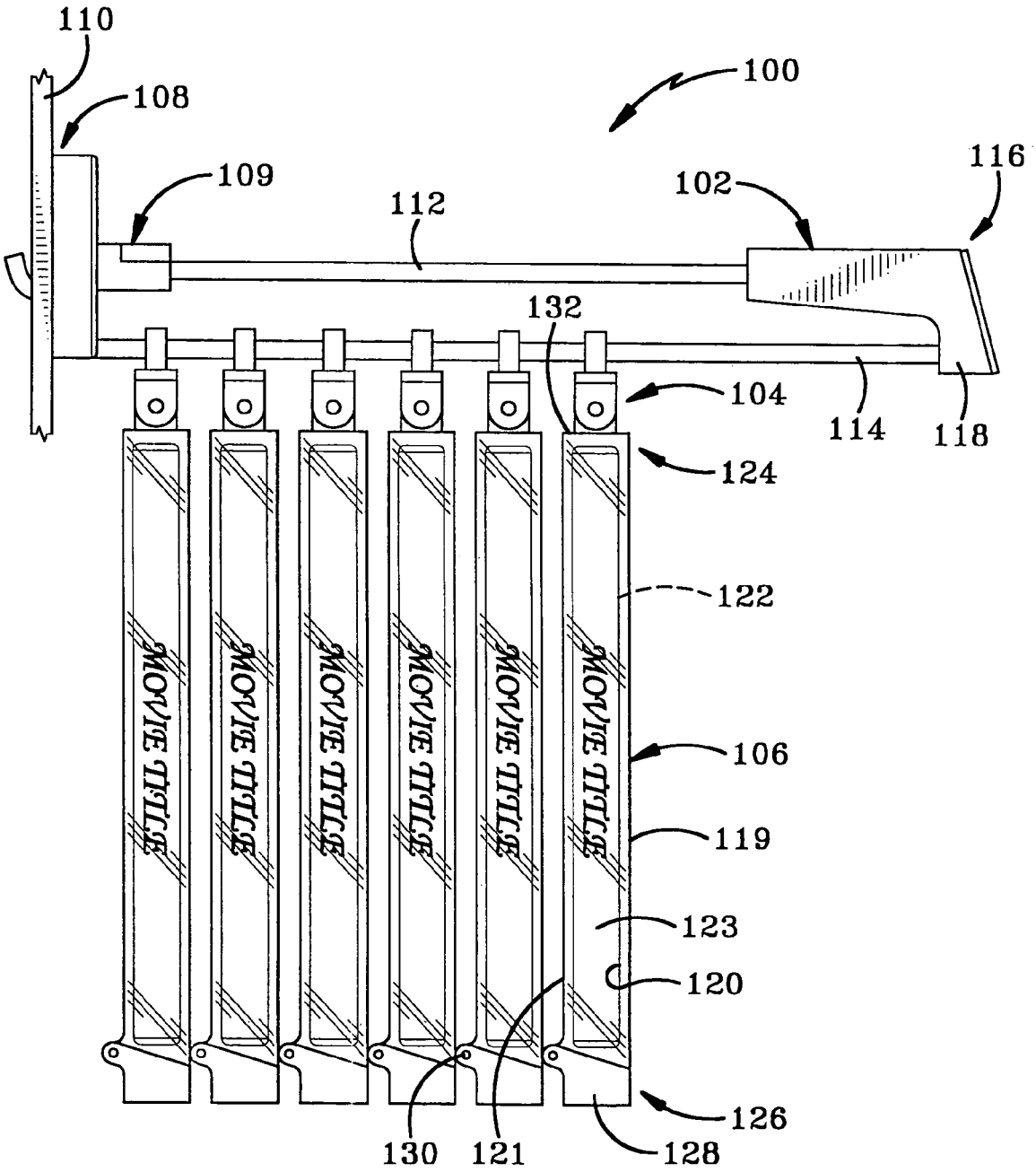
FIG. 1 is a side elevational view of the first embodiment showing the merchandise display system of the present invention.
Figure 2:
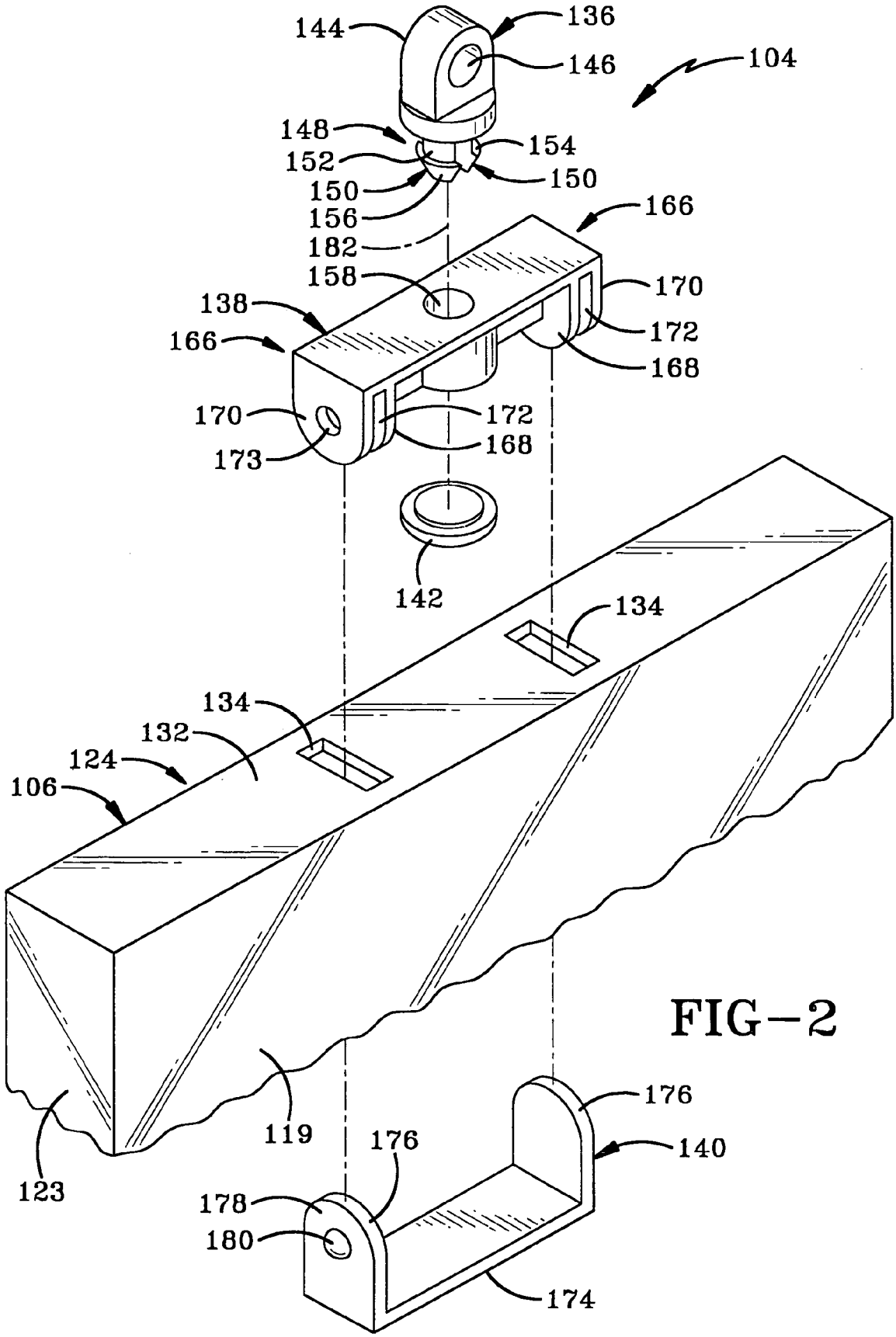
FIG. 2 is a fragmentary exploded perspective view of the first embodiment showing the various members of the hanging assembly and the display case.
Figure 3:
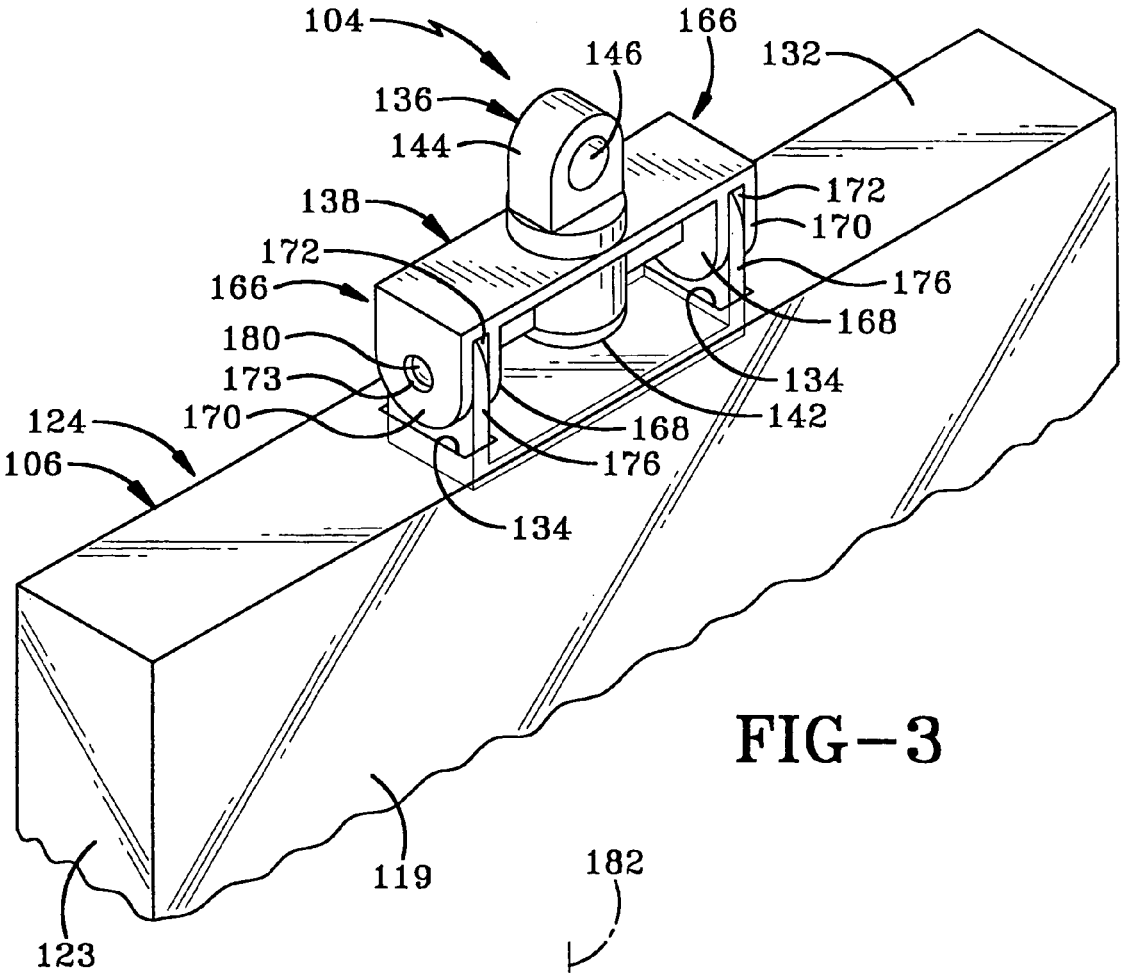
FIG. 3 is a fragmentary perspective view of the first embodiment of the hanging assembly and display case.
Figure 4:
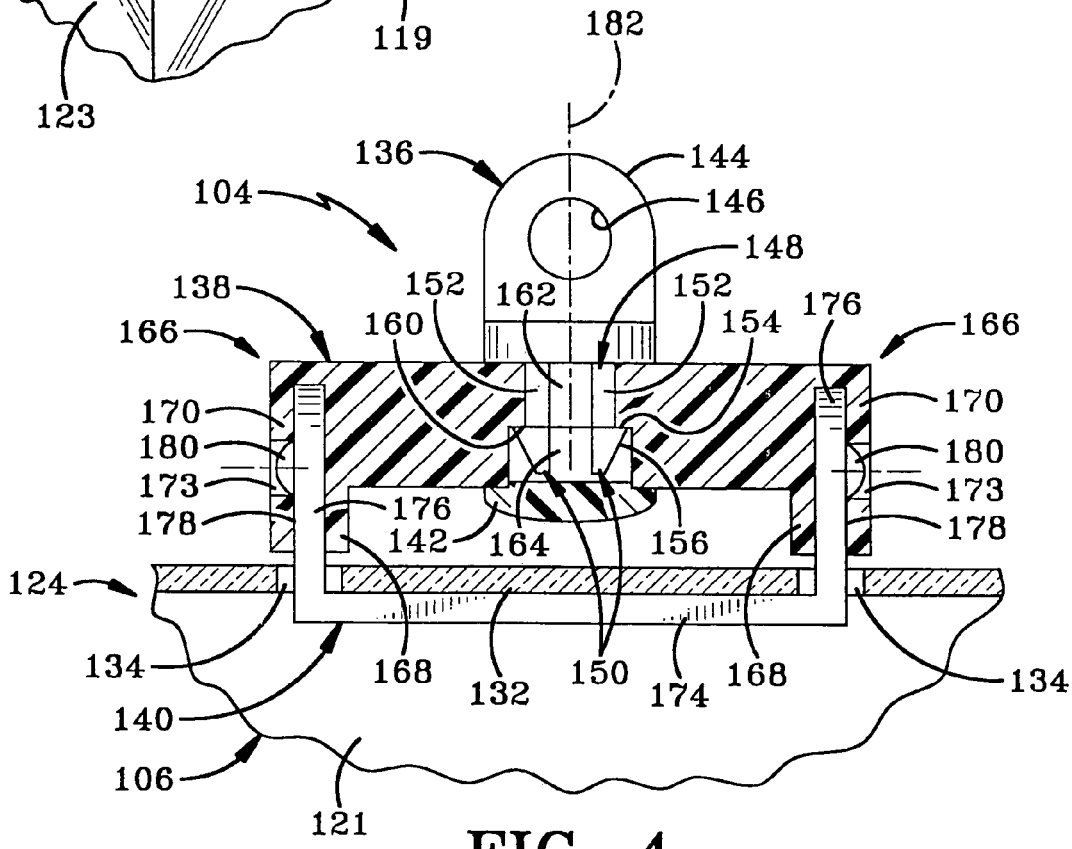
FIG. 4 is a fragmentary partial sectional view of the first embodiment of the hanging assembly and the display case.

A first embodiment of the merchandise display system of the present invention is indicated generally at 100 and is shown in FIGS. 1–9. Display system 100 includes a lockable rod assembly 102, a hanging assembly 104 which hangs from rod assembly 102 and a lockable merchandise display case 106 which is connected to and hangs from hanging assembly 104. Hanging assembly 104 is configured to allow display case 106 and merchandise 122 within to pivot and swivel in a manner such that the consumer can easily handle case 106 and view merchandise 122 within case 106.

Lockable rod assembly 102 includes an inner end 108 which is lockable to a peg board 110 or the like. Inner end 108 may also be securely fixed to a wall or other type of display unit. Rod assembly 102 includes lockable base assembly 109 adjacent inner end 108. Rod assembly 102 further includes an upper rod 112 and a lower rod 114 which are substantially parallel and extend outwardly and horizontally from inner end 108 to an outer end 116. Inner rod assembly 102 further includes a locking mechanism 118 adjacent outer end 116, the locking mechanism locking onto rod 114 to prevent removal of merchandise from lower rod 114. One embodiment of a rod assembly that may be used is more fully described in U.S. Pat. No. 6,474,478 granted to Huehner et al. on Nov. 5, 2002, and said patent is incorporated herein by reference.

Display case 106 includes an interior chamber 120 in which is inserted an item of merchandise 122. Display case 106 includes a front side 119, a back side 121, and a pair of lateral sides 123. Display case 106 further includes an upper end 124 and a lower end 126. A lockable door 128 is hingedly connected to case 106 by hinge 130 adjacent lower end 126. Case 106 also includes an upper wall 132 adjacent upper end 124 in opposed relation to door 128. Upper wall 132 defines a pair of slots 134 for receiving a portion of hanging assembly 104 as described below. Any of a variety of known lockable cases may be used as display case 106.

In accordance with the present invention, hanging assembly 104 includes a hanging member 136, a swivel member 138, a U-shaped lower member 140 and a cap 142. Hanging member 136 has an upper portion 144 which defines a hole 146 for receiving lower rod 114. Hanging member 136 further includes a lower portion 148 which includes a pair of downwardly extending spaced prongs 150 each of which includes a neck 152, a shoulder 154 extending outwardly from neck 152 and a surface 156 which tapers downwardly and inwardly from shoulder 154.

Swivel member 138 defines a vertical hole 158 for receiving prongs 150 of hanging member 136. Swivel member 158 further includes shoulders 160 (FIG. 4) which separate a cylindrical upper chamber 162 and a cylindrical lower chamber 164 of hole 158, the upper chamber having a smaller diameter than the lower chamber. Hole 158 is configured to receive prongs 150 of hanging member 136 such that shoulders 160 and shoulders 154 engage one another in a snap fit engagement which prevents removal of hanging member 136 from swivel member 138. Tapered surfaces 156 facilitate in section of prongs 150 into hole 158. Cap 142 covers lower chamber 164 of hole 158 and may do so by snap fit engagement or be secured in another manner known in the art. Swivel member 138 has ends 166, from each of which extend downwardly an inner tab 168 and an outer tab 170 opposed to one another in spaced relation to define a slot 172. Outer tab 170 defines a horizontal hole 173.

Figure 8:
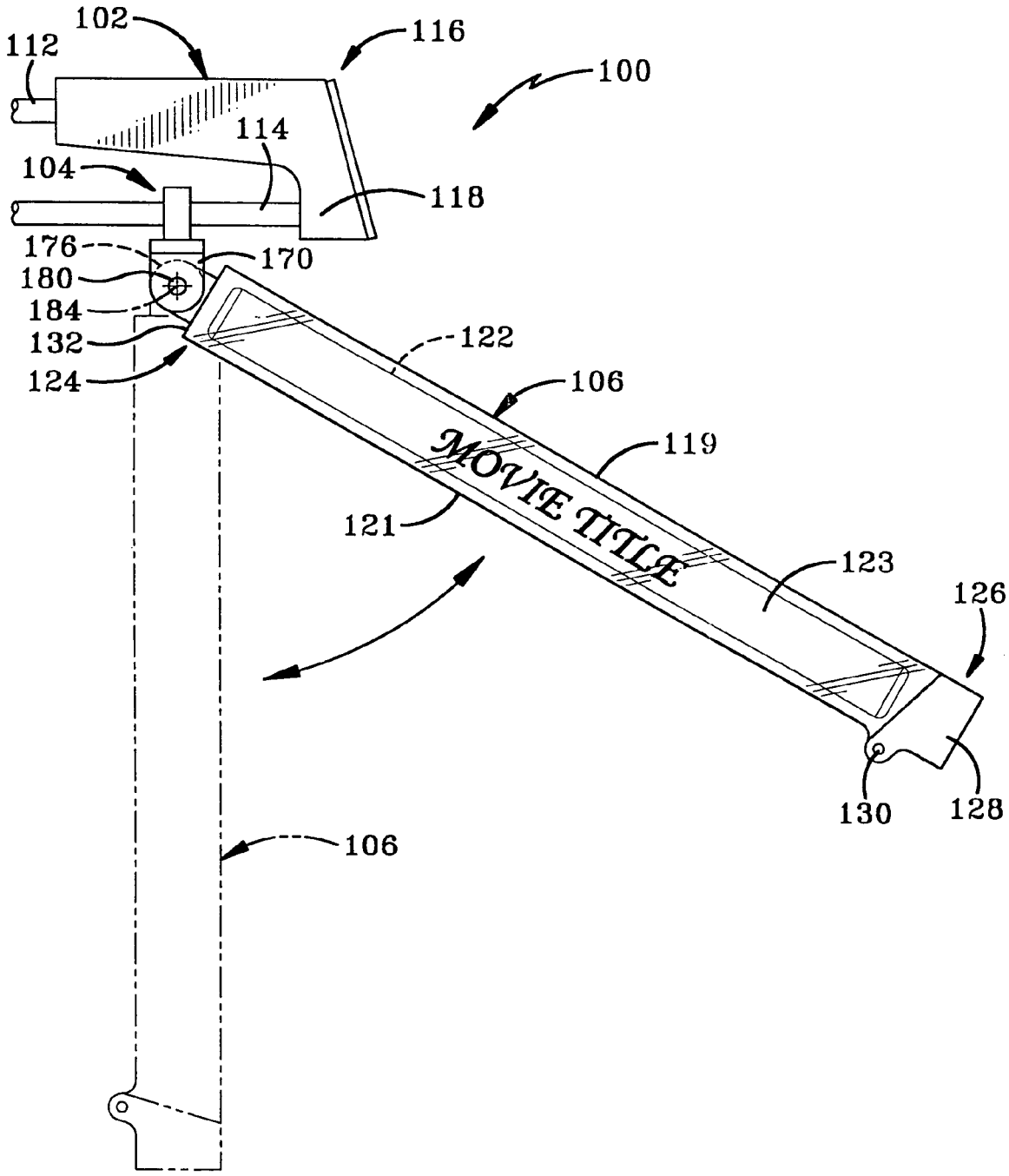
FIG. 8 is a fragmentary side elevational view of the first embodiment showing the display case rotated upwardly from the display position (shown in phantom lines).

U-shaped lower member 140 includes a substantially flat and rectangular base member 174 from which extend upwardly a pair of spaced tabs 176 in opposed relation to one another. Each tab 176 has an outer surface 178 from which extends a dome-shaped knob 180. Base member 174 of lower member 140 is configured to be positioned in interior chamber 120 of display case 106 adjacent upper wall 132 to provide the connection of member 174 to case 106. Tabs 176 of member 140 extend through slots 134 in upper wall 132 of display case 106 and into slots 172 of swivel member 138. Knobs 180 slide into respective holes 173 in outer tabs 170 to form a snap fit engagement. An axis 182 extends vertically through hole 158 of swivel member 138 and also between prongs 150 of hanging member 136. An axis 184 passes through knobs 180, as shown in FIG. 8.

Figure 5:
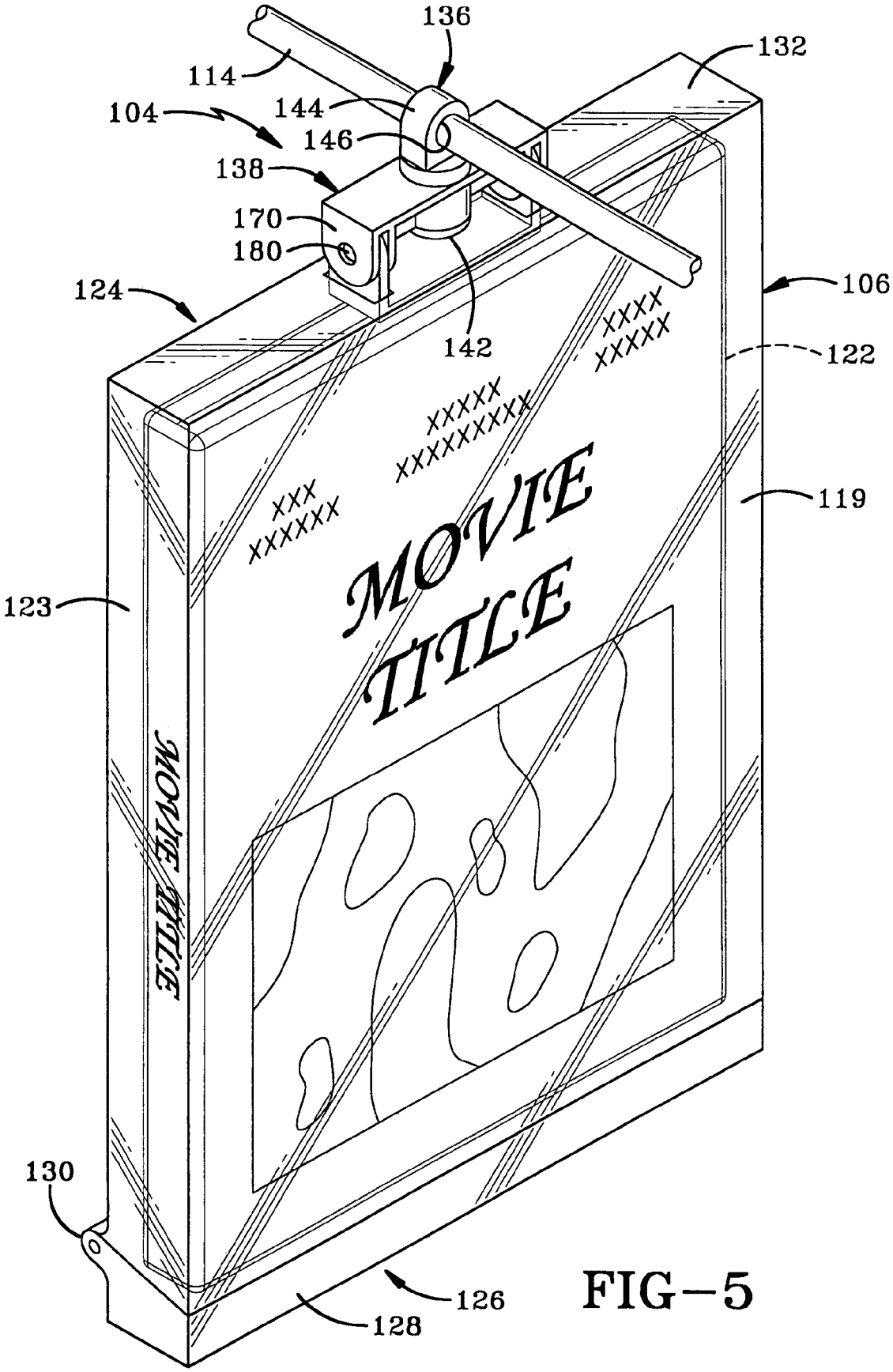
FIG. 5 is a fragmentary perspective view of the first embodiment showing the display case and hanging assembly hanging from the lower rod in a display position.
Figure 6:
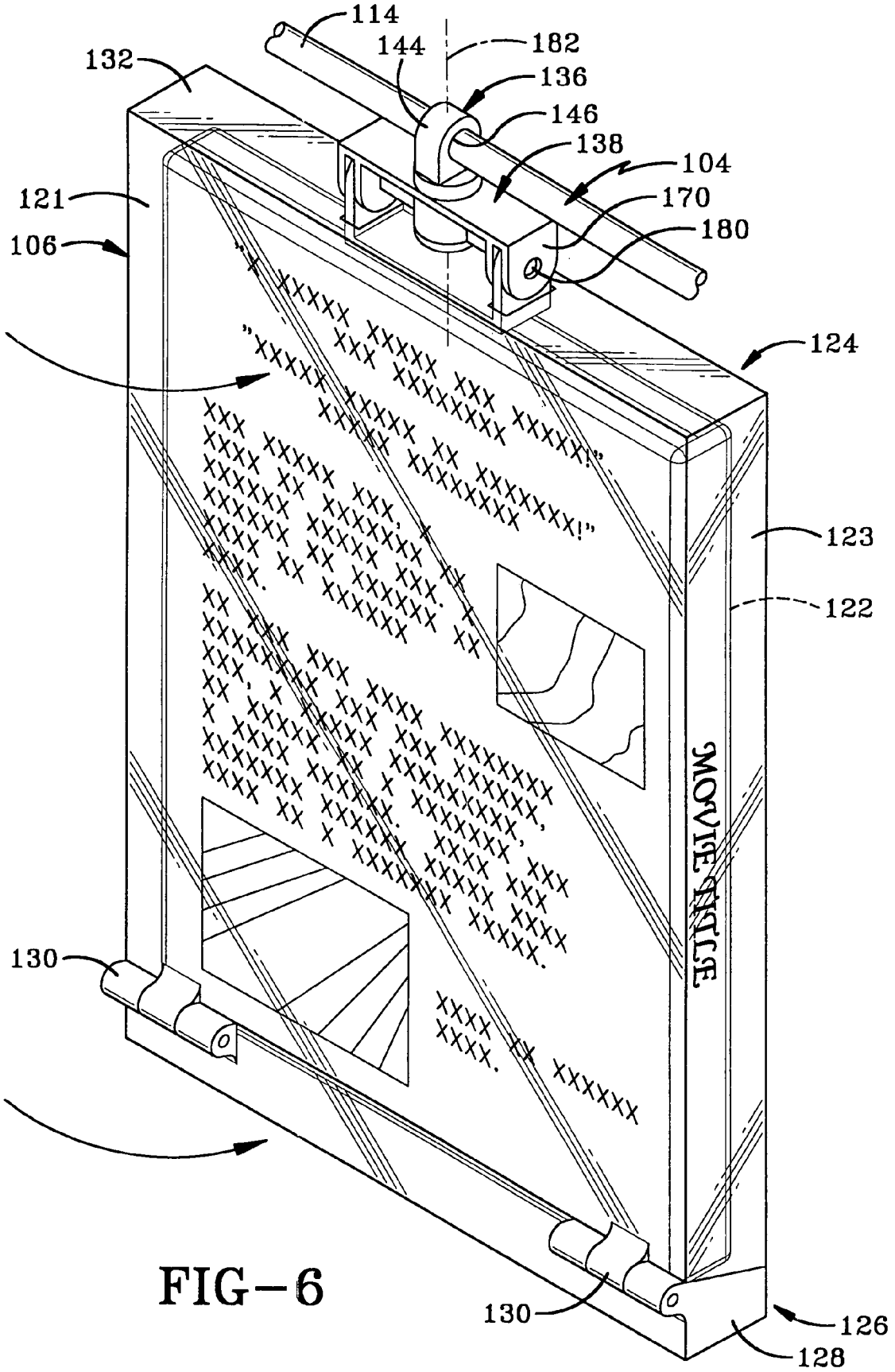
FIG. 6 is a fragmentary perspective view of the first embodiment similar to FIG. 5 with the hanging assembly and display case in a partially rotated position.

In operation, hanging assembly 104 allows display case 106 to be maneuvered easily in a great variety of positions so that a consumer can easily view all sides of merchandise 122 encased therein. FIGS. 5–9 indicate the various positions of the case and show its maneuverability and overall use. As seen in FIG. 5, hanging assembly 104 is in a display position as it ordinarily would be for display purposes as it hangs from lower rod 114 of rod assembly 102. In this position, swivel member 138 and display case 106 are situated substantially normal to lower rod 114 as viewed from above. FIG. 6 shows hanging assembly 104 along with display case 106 in a position rotated approximately 90° from the position shown in FIG. 5 about axis 182. In this position, swivel member 138 and display case 106 are situated substantially parallel to lower rod 114 as viewed from above. Swivel member 138 swivels about axis 182 as supported by shoulders 160 resting on shoulders 154 of prongs 150. The diameter of upper chamber 162 of hole 158 is large enough to allow chamber 162 to rotate about neck 154 of prongs 150 while the diameter of lower chamber 164 likewise allows rotation about tapered surfaces 156 of prong 150. Cap 142 functions to prevent tampering with prongs 150 by a shoplifter attempting to break prongs 150 or disengage them from within hole 158. The display position of FIG. 5 shows upper wall 132, front side 119 and lateral sides 123. FIG. 6, like FIG. 5, continues to show upper wall 132 and the same lateral side 123, but in the 90° swivelled position also shows back side 121 of case 106.

Figure 7:
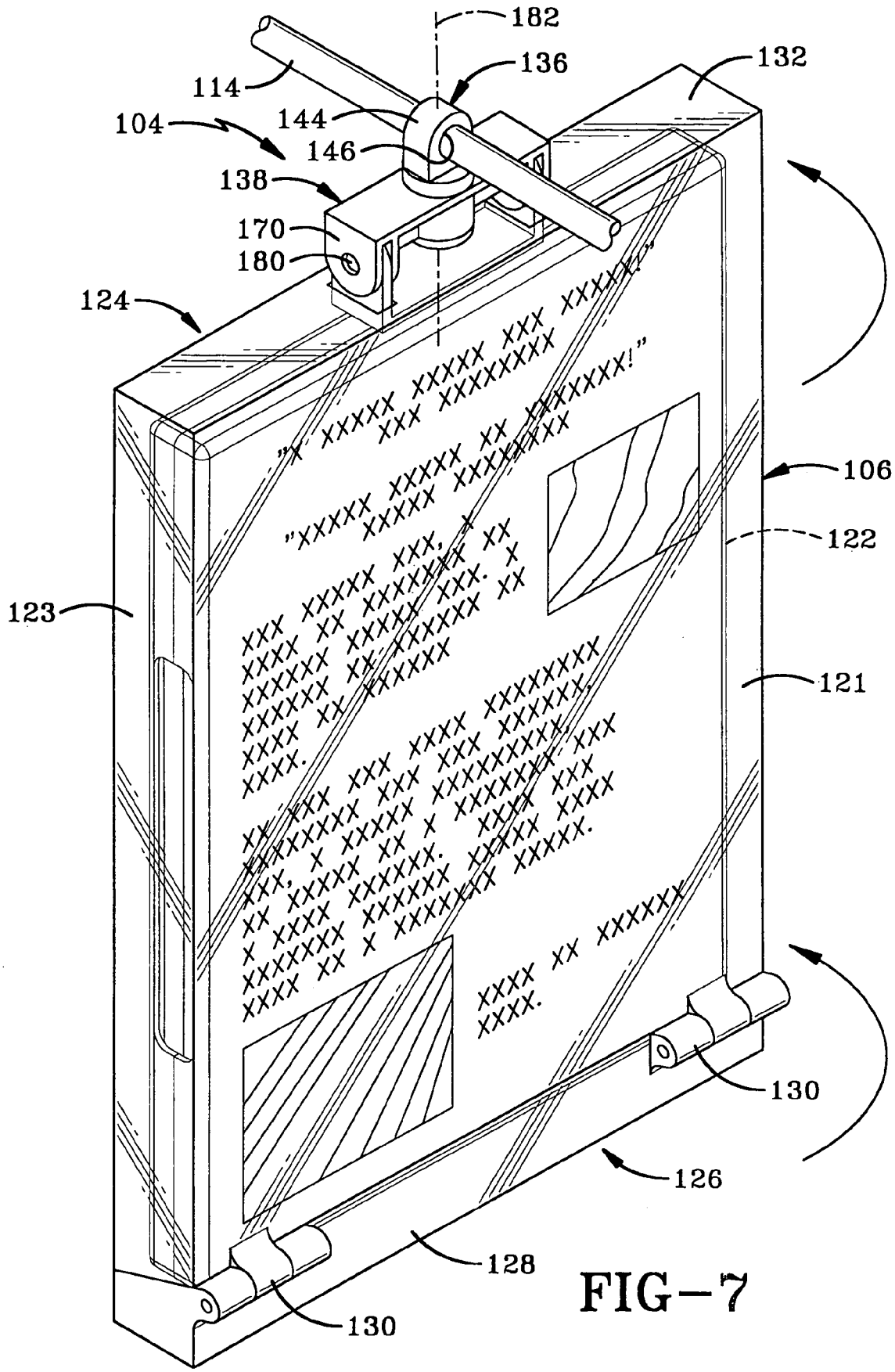
FIG. 7 is a fragmentary perspective view of the first embodiment similar to FIGS. 5 and 6 showing the display case and hanging assembly in a further rotated position.

FIG. 7 shows hanging assembly 104 and display case 106 rotated approximately 180° from the display position shown in FIG. 5. Thus, FIG. 7 shows back side 121 and upper wall 132 along with the other lateral side 123 of display case 106. The rotational movement of swivel member 138 allows swivel member 138 and display case 106 to rotate 360° about axis 182, thereby allowing all sides of display case 106 and merchandise 122 encased therein to be seen by consumers. Because a plurality of items of merchandise 122 are displayed within respective cases 106 hanging from lower rod 114, ordinarily the simple rotational movement allowed by swivel member 138 may not be sufficient to allow a consumer to view all the sides easily due to interference of such movement by the other cases 106. This difficulty is resolved by the additional ability of hanging assembly 104 to pivot upwardly as shown in FIG. 8.

Figure 9:
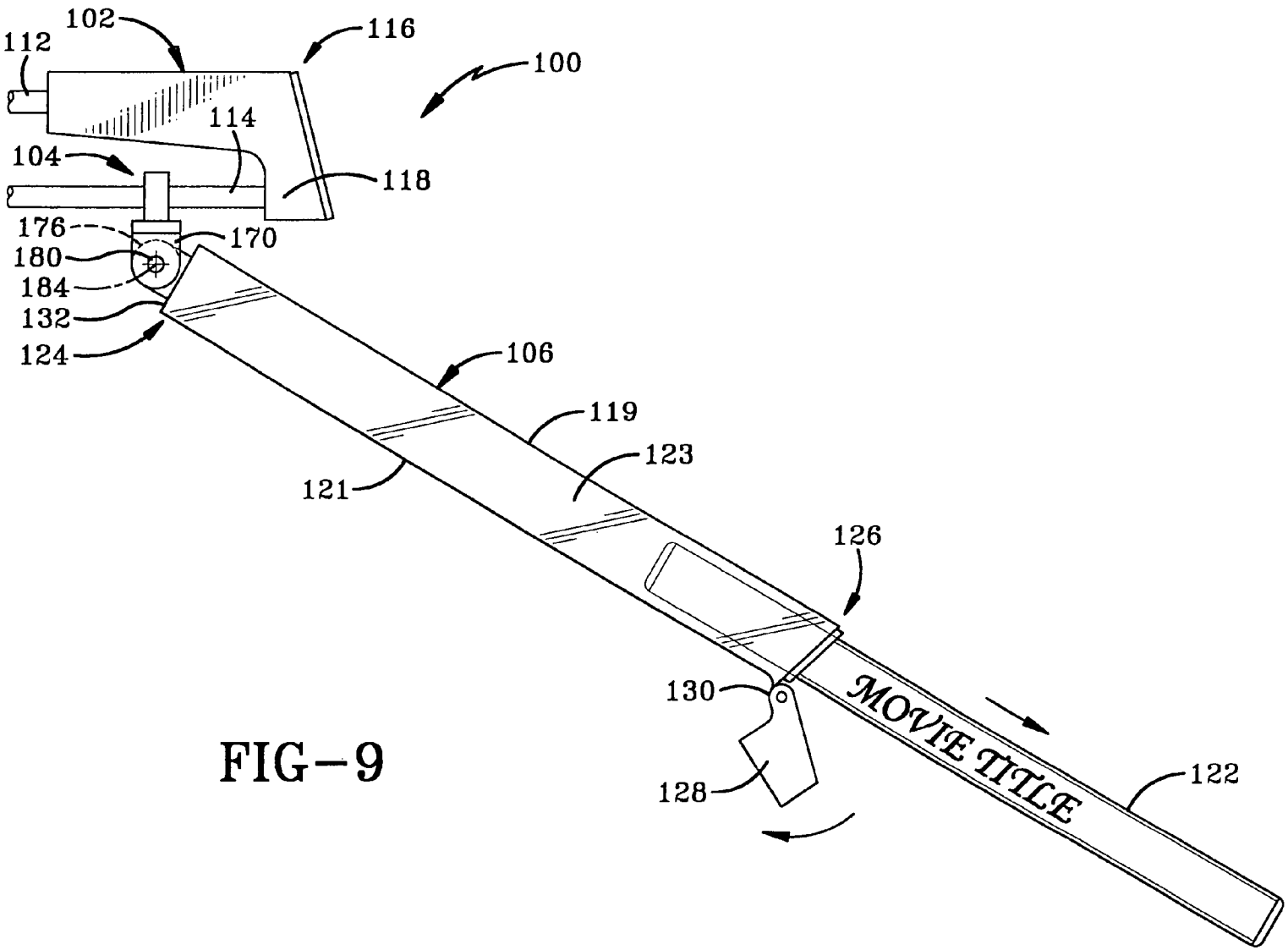
FIG. 9 is a fragmentary side elevational view of the first embodiment similar to FIG. 8 showing the door of the display case being opened and the merchandise being removed from the display case.
Figure 10:
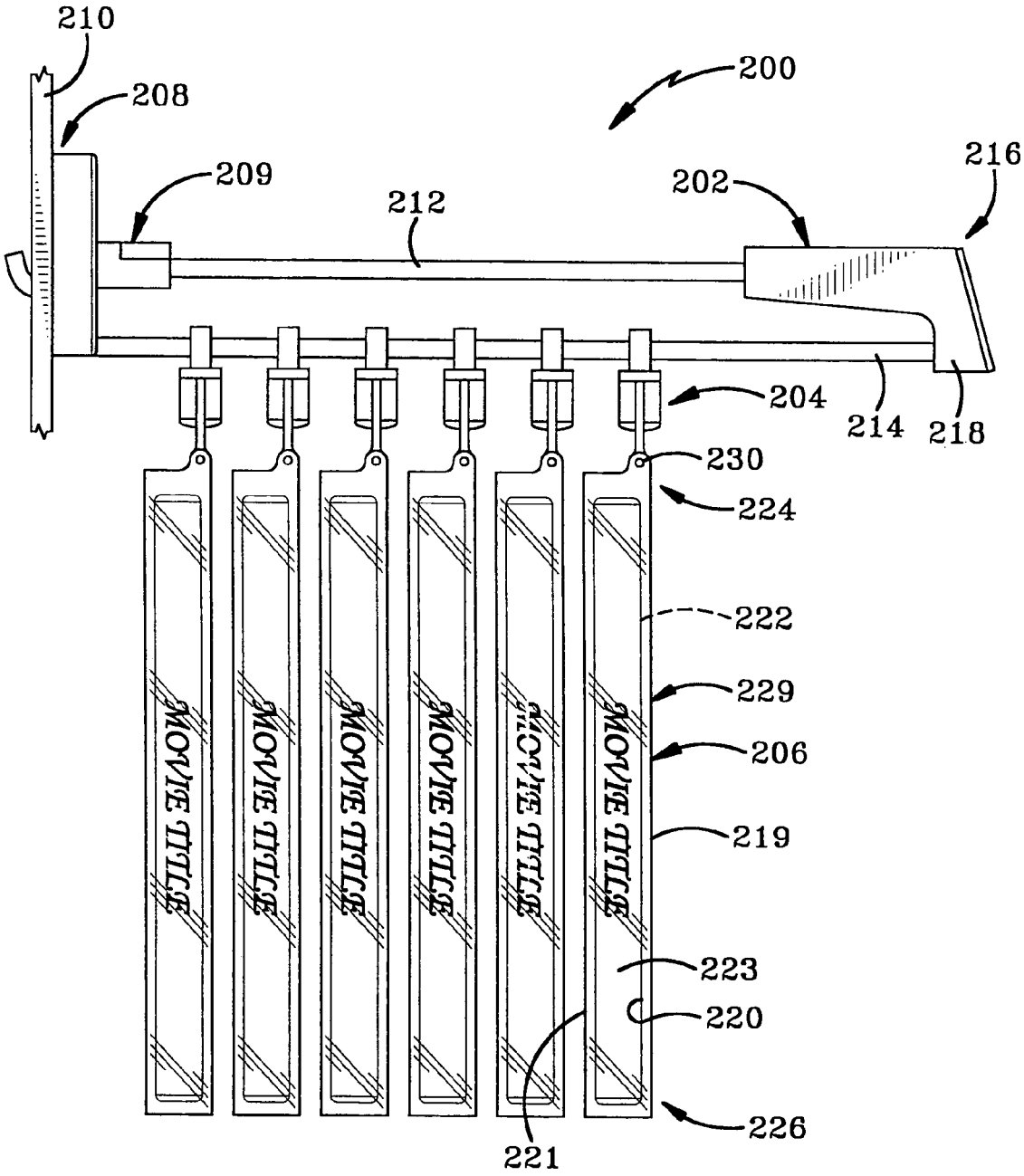
FIG. 10 is a side elevational view of a second embodiment of the present invention.
Figure 11:
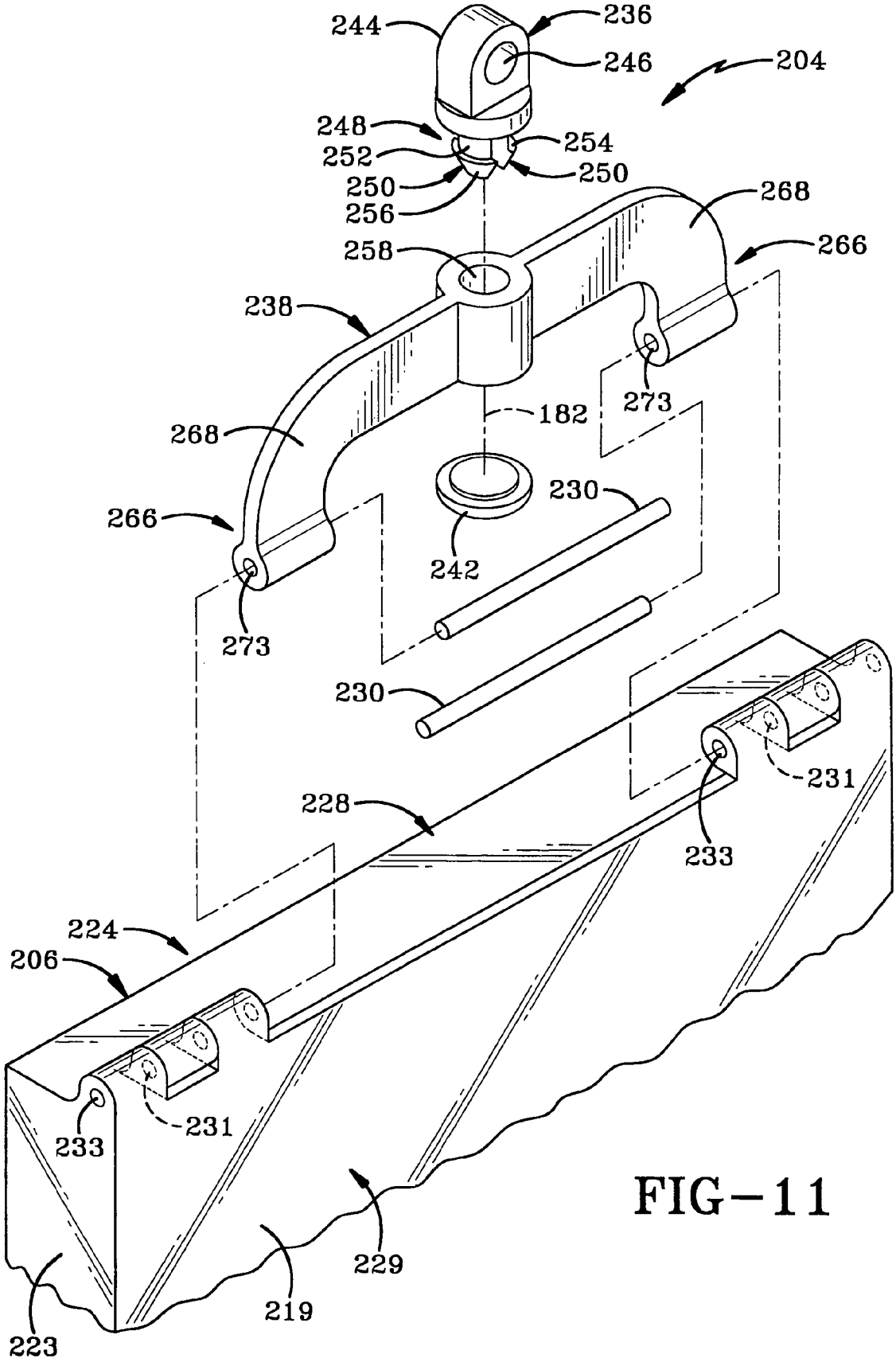
FIG. 11 is a fragmentary exploded view of the second embodiment showing the hanging assembly and display case.
Figure 12:
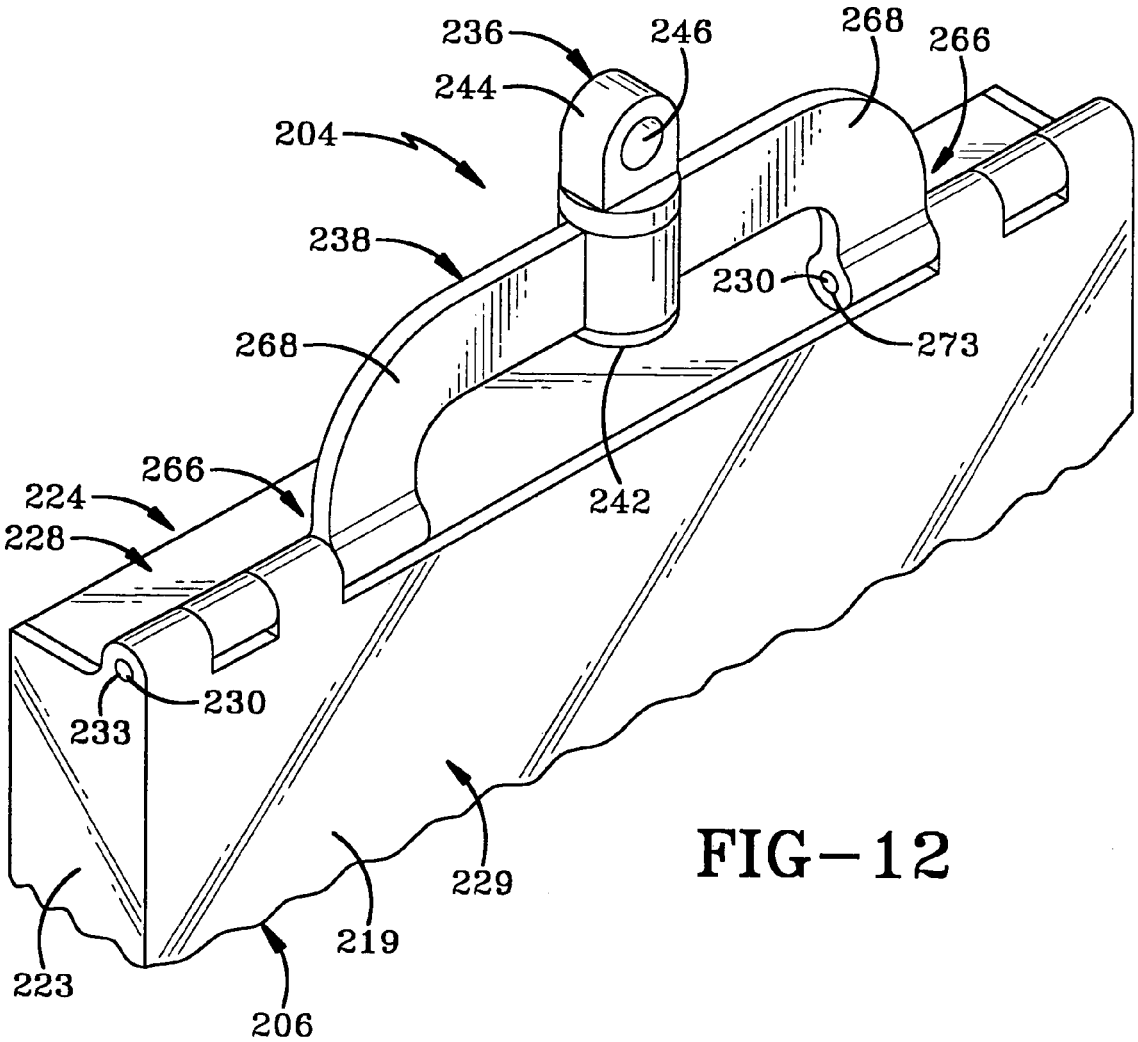
FIG. 12 is a perspective view of the second embodiment showing the hanging assembly and display case.
Figure 13:
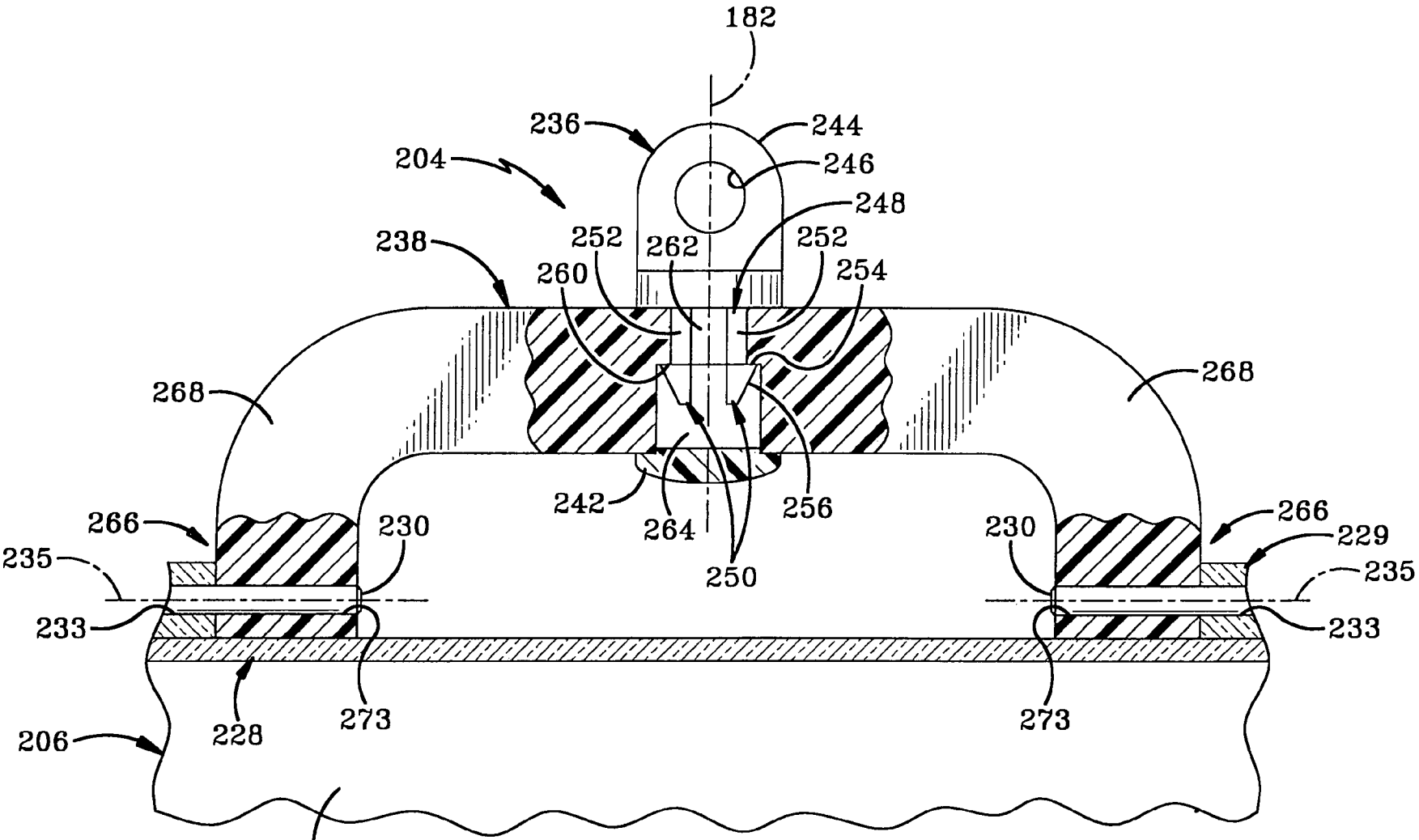
FIG. 13 is a fragmentary partial sectional view of the second embodiment showing the hanging assembly and the display case.

More particularly, lower member 140 is configured to rotate about axis 184 which passes through knobs 180. Tabs 176 of lower member 140 move freely within slots 172 defined by swivel member 138 and knobs 180 move freely within respective holes 173. However, the snap fit engagement of knobs 180 into holes 173 is sufficiently secure to prevent removal by a shoplifter or make such removal rather difficult. The rotational motion about axis 184 allows display case 106 to travel an arc of at least 180° in the direction between inner end 108 and outer end 116 of rod assembly 102, limited only by interference with lower rod 114, locking mechanism 118, base assembly 109, peg board 110, or any other display cases 106 hanging from rod 114. Referring back to the position shown in FIG. 6, the rotational motion indicated in FIG. 8 from the position shown in FIG. 6 would allow case 106 to be moved in a far broader arc approaching that of a full circle, limited only by the interference with upper rod 112 and other such members. The overall movement allowed by the rotation about axes 182 and 184 allows display case 106 to be maneuvered in nearly any position so that item of merchandise 122 can be easily viewed and relevant information read from all sides of said item. The overall movement of display case 106 is also facilitated and enhanced by the fact that hanging assembly 104 is able to rotate about lower rod 114. FIG. 9 shows display case 106 rotated upwardly towards outer end 116 of rod assembly 102. Further, lockable door 128 is shown in an open position after rotating about hinge 130. Finally, item of merchandise 122 is shown being removed from case 106.

Thus, merchandise display system 100 provides a secure system by which items of merchandise 122 are encased in display cases 106 which have lockable doors 128 to prevent merchandise 122 from being removed without authorization. Further, system 100 prevents unauthorized removal from lower rod 114 of hanging assembly 104 and display case 106 hanging therefrom. System 100 also allows the consumer to maneuver display case 106 with item of merchandise 122 therein to easily view merchandise 122 without the need for removal from rod 114. Thus, system 100 provides security for the seller as well as convenient review of merchandise 122 for the consumer.

A second embodiment of the merchandise display system of the present invention is indicated generally at 200 and is shown in FIGS. 10–15. Display system 200 includes a lockable rod assembly 202, a hanging assembly 204 which hangs from rod assembly 202 and a lockable merchandise display case 206 which is connected to and hangs from hanging assembly 204. Hanging assembly 204 is configured to allow display case 206 and merchandise 222 within to pivot and swivel in a manner such that the consumer can easily handle case 206 and view merchandise 222 within case 206.

Lockable rod assembly 202 includes an inner end 208 which is lockable to a peg board 210 or the like. Rod assembly 202 includes lockable base assembly 209 adjacent inner end 208. Rod assembly 202 further includes an upper rod 212 and a lower rod 214 which are substantially parallel and extend outwardly and horizontally from inner end 208 to an outer end 216. Inner rod assembly 202 further includes a locking mechanism 218 adjacent outer end 216, the locking mechanism locking onto rod 214 to prevent removal of merchandise from lower rod 214. Rod assembly 202 is more fully described in U.S. Pat. No. 6,474,478, as noted above.

Display case 206 includes an interior chamber 220 in which is inserted an item of merchandise 222. Display case 206 includes a front side 219, a back side 221, and a pair of lateral sides 223. Display case 206 further includes an upper end 224 and a lower end 226. Unlike display case 106, display case 206 does not have a lockable door adjacent the lower end. Instead, display case 206 includes an inner shell 228 and an outer shell 229 which rotate about a pair of common hinge pins 230 (FIG. 11) between a closed position (FIG. 14) and an open position (FIG. 15), the inner shell and outer shell being lockable in the closed position.

In accordance with the present invention, hanging assembly 204 includes a hanging member 236, a swivel member 238, hinge pins 230 and a cap 242. Hanging member 236 has an upper portion 244 which defines a hole 246 for receiving lower rod 214. Hanging member 236 further includes a lower portion 248 which includes a pair of downwardly extending prongs 250 each of which includes a neck 252, a shoulder 254 extending outwardly from neck 252 and a surface 256 which tapers downwardly and inwardly from shoulder 254.

Swivel member 238 defines a vertical hole 258 for receiving prongs 250 of hanging member 236. Swivel member 258 further includes shoulders 260 (FIG. 13) which separate a cylindrical upper chamber 262 and a cylindrical lower chamber 264 of hole 258, the upper chamber having a smaller diameter than the lower chamber. Hole 258 is configured to receive prongs 250 of hanging member 236 such that shoulders 260 and shoulders 254 engage one another in a snap fit engagement which prevents removal of hanging member 236 from swivel member 238. Tapered surface 256 facilitates in section of prongs 150 into hole 258. Cap 242 covers lower chamber 264 of hole 258 and may do so by snap fit engagement or be secured in another manner known in the art. Swivel member 238 has ends 266 and a pair of arms 268 extending downwardly adjacent respective ends 166. Arms 268 define a pair of respective horizontal holes 273 which are substantially in alignment with one another and also configured to align with hinge holes 231 formed in inner shell 228 and hinge holes 233 formed in outer shell 229 of display case 206. Hinge pins 230 are inserted in hinge holes 231 and 233 and into hole 273 in arms 268, thereby allowing for rotational movement about axis 235 (FIG. 13), which extends through hinge pins 230. This rotational movement may be accomplished, for example, by the diameters of hinge holes 233 of outer shell 229 forming a snug fit with hinge pins 230 while hinge holes 231 of inner shell 228 and holes 273 of arms 268 are large enough to permit a rotational movement of hinge pins 230.

In operation, hanging assembly 204 allows display case 206 to be maneuvered easily in a great variety of positions so that a consumer can easily view all sides of merchandise 222 encased therein. FIGS. 5–7 showing the first embodiment of the present invention are generally applicable as to the movement of the second embodiment as well, and in combination with FIGS. 14–15, indicate the various positions of the case and show its maneuverability and overall use. Hanging assembly 204 functions in the same manner as hanging assembly 104 in regard to the rotational or swiveling properties as viewed from above, as described in regard to assembly 104 above.

Figure 14:
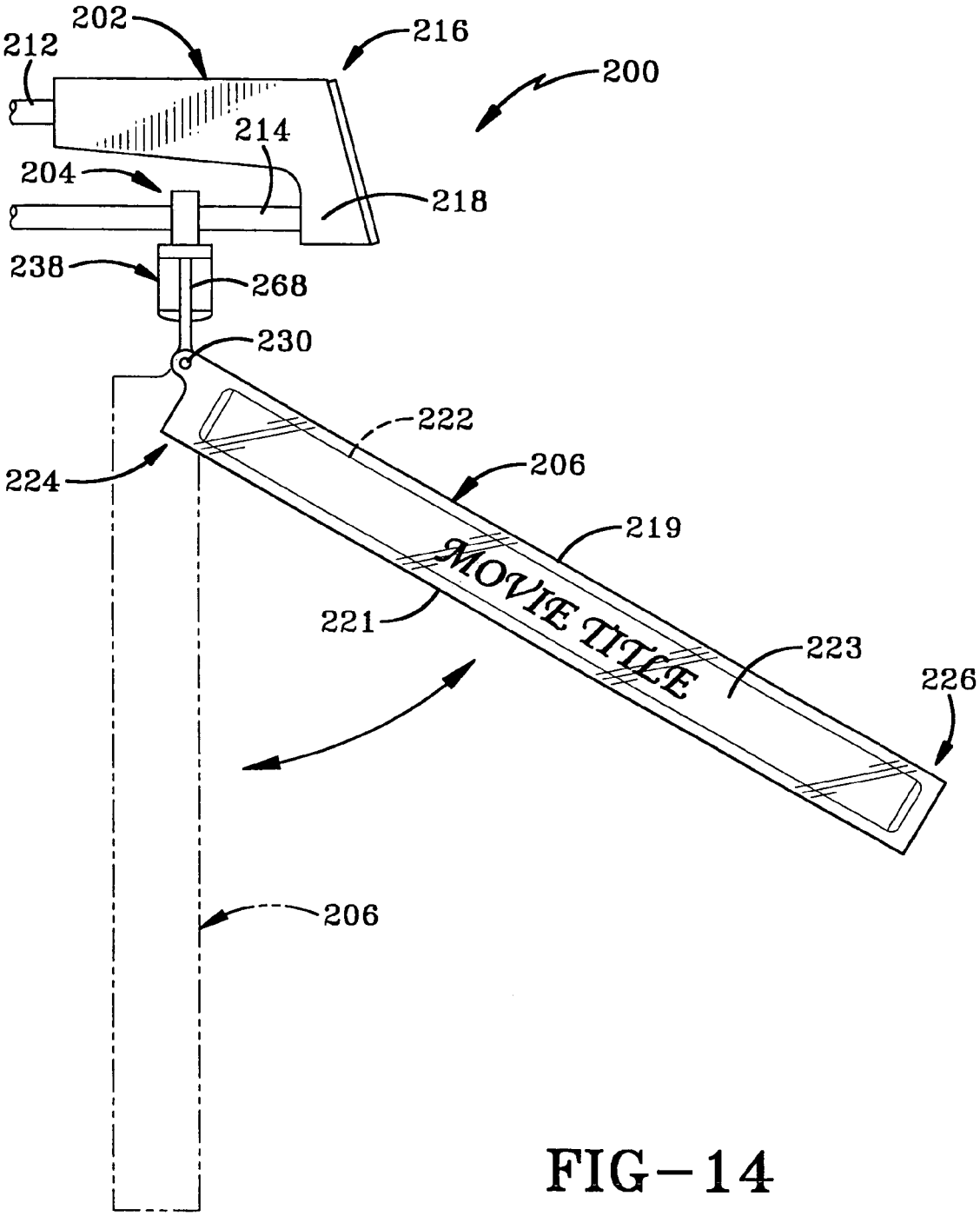
FIG. 14 is a fragmentary side elevational view of the second embodiment showing a display case rotated upwardly from a display position (shown in phantom lines).

Like assembly 104, hanging assembly 204 pivots upwardly as shown in FIG. 14. While the same motion is allowed, assembly 204 utilizes a different configuration to achieve that effect. More particularly, with hinge pins 230 inserted into hinge holes 231 and 233 of display case 206 and holes 273 of arms 268, display case 206 is able to rotate about axis 235 with respect to swivel member 238. The maneuverability of display case 206 about axis 235 is essentially the same as display case 106 about axis 184. Further, the overall maneuverability of display case 206 is substantially the same as that of case 106, as described above.

Figure 15:
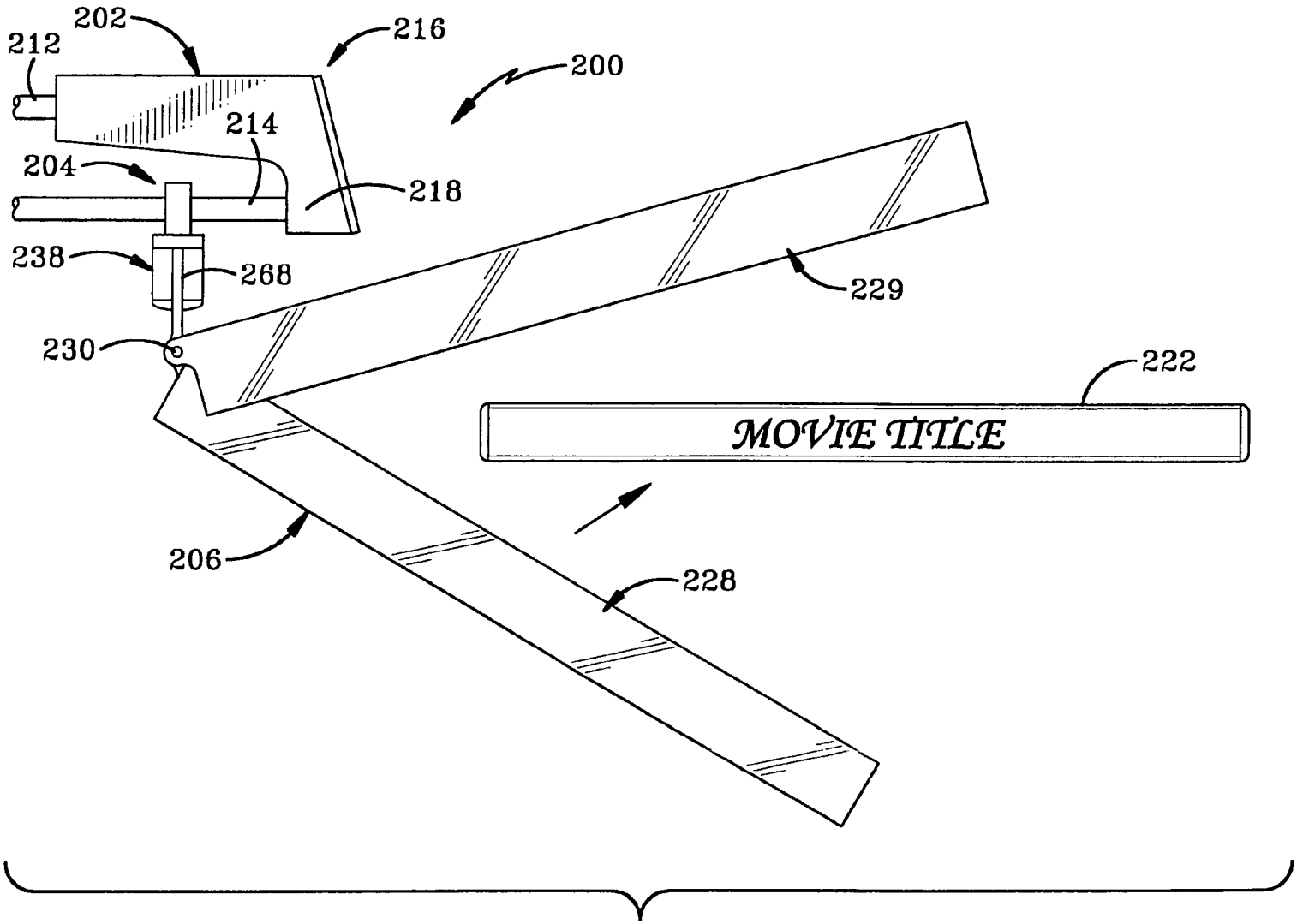
FIG. 15 is a fragmentary side elevational view of the second embodiment showing the display case in an open position with the item of merchandise being removed therefrom.
Figure 16:
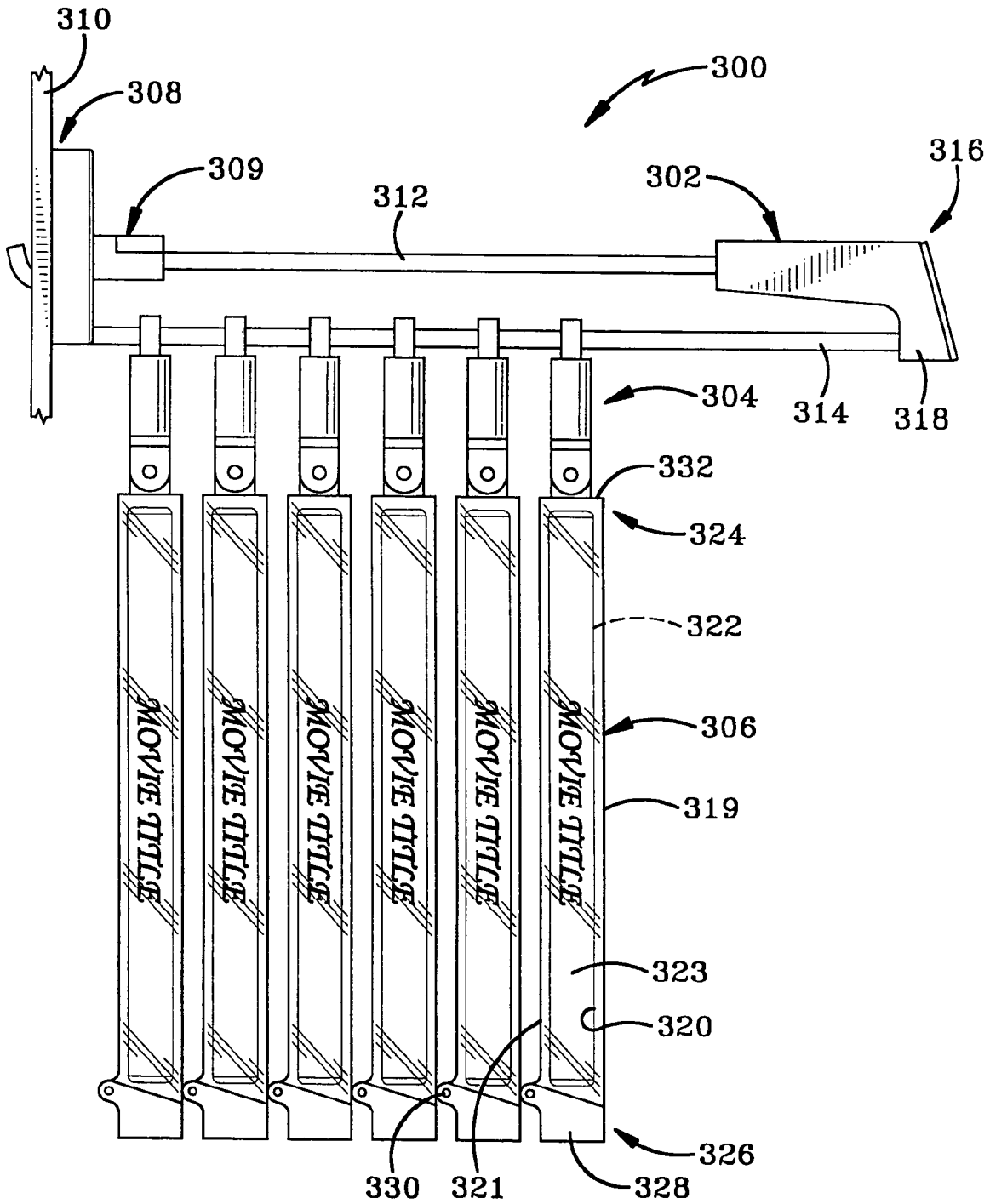
FIG. 16 is a side elevational view of a third embodiment of the present invention.
Figure 17:
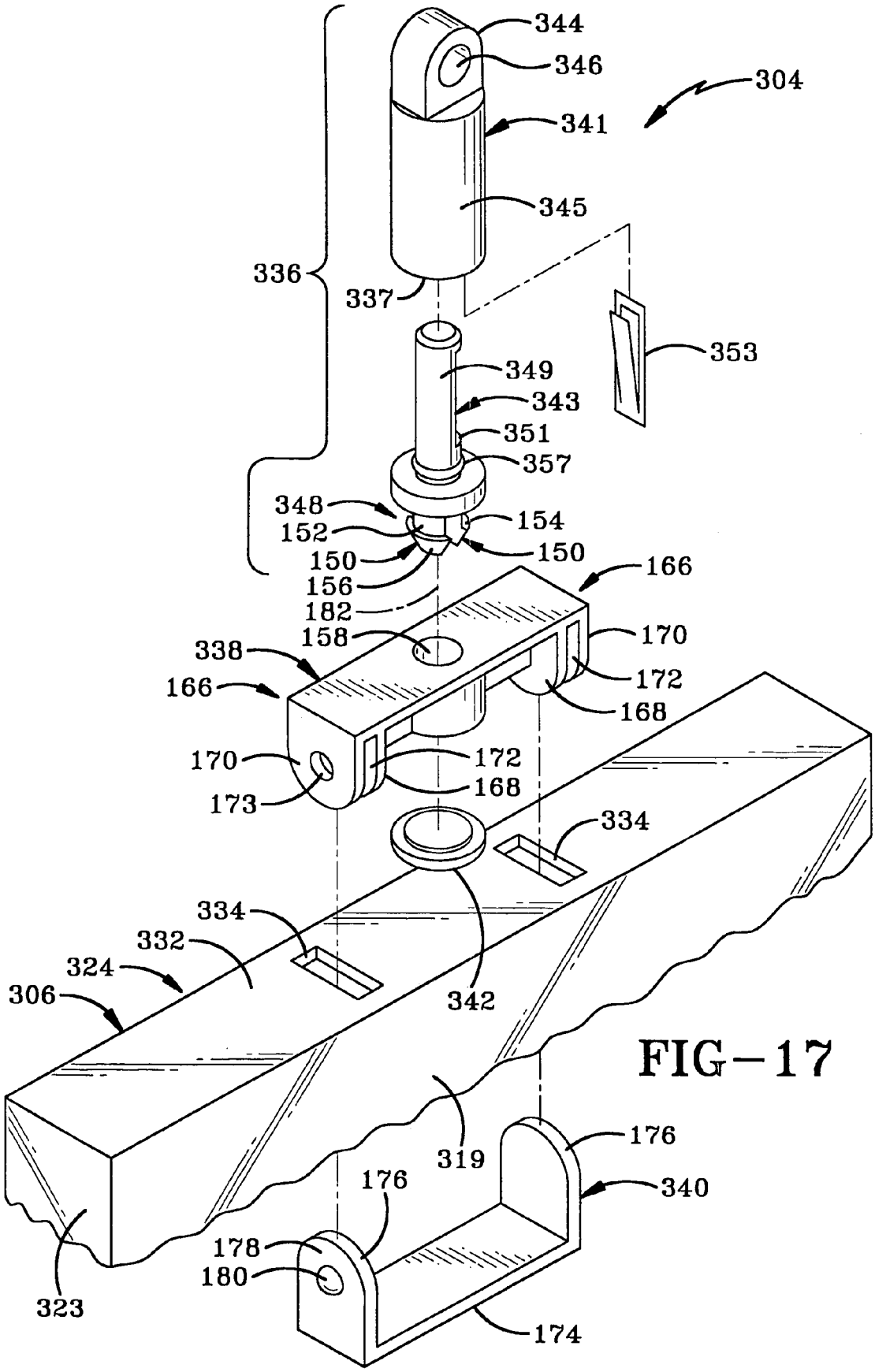
FIG. 17 is a fragmentary exploded view of the third embodiment showing the hanging assembly and display case.
Figure 18:
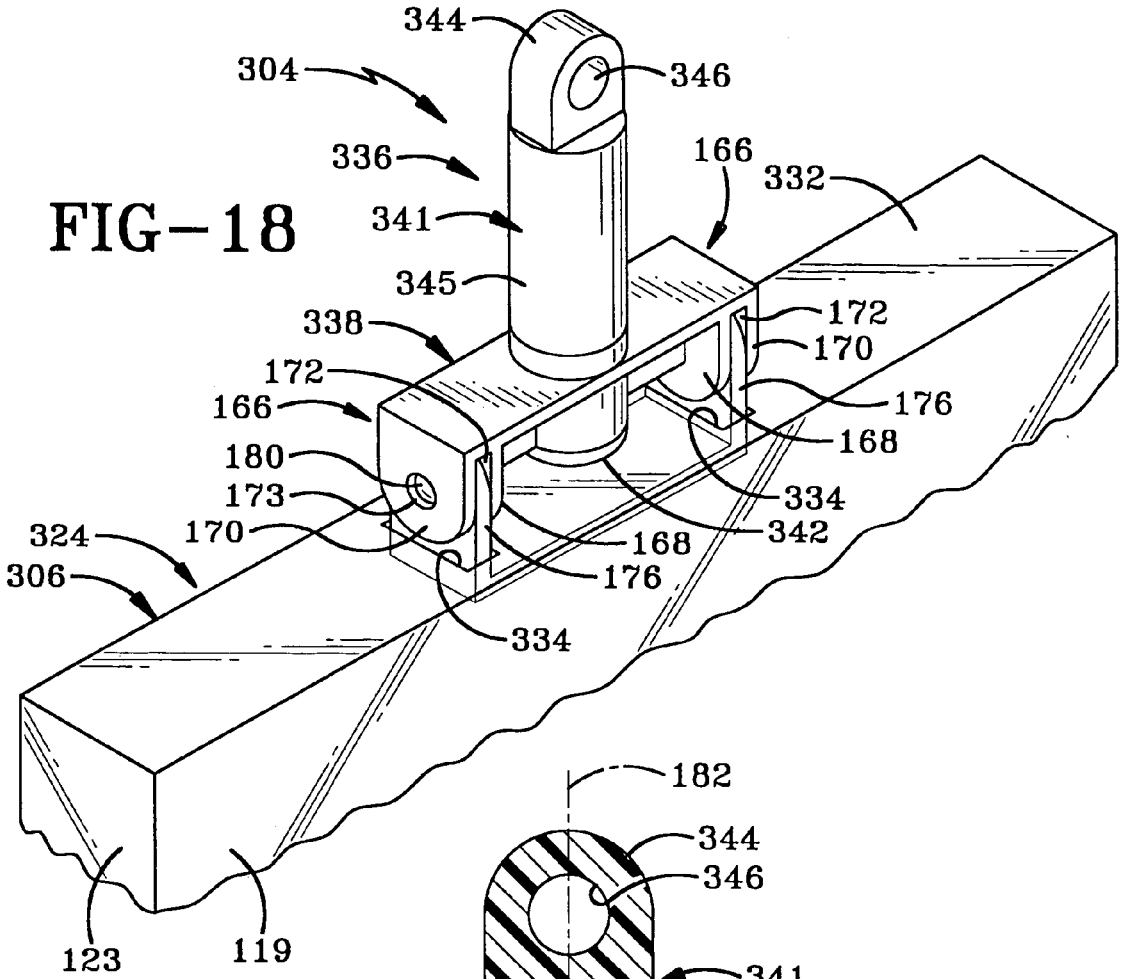
FIG. 18 is a fragmentary perspective view of the third embodiment showing the hanging assembly and display case.
Figure 19:
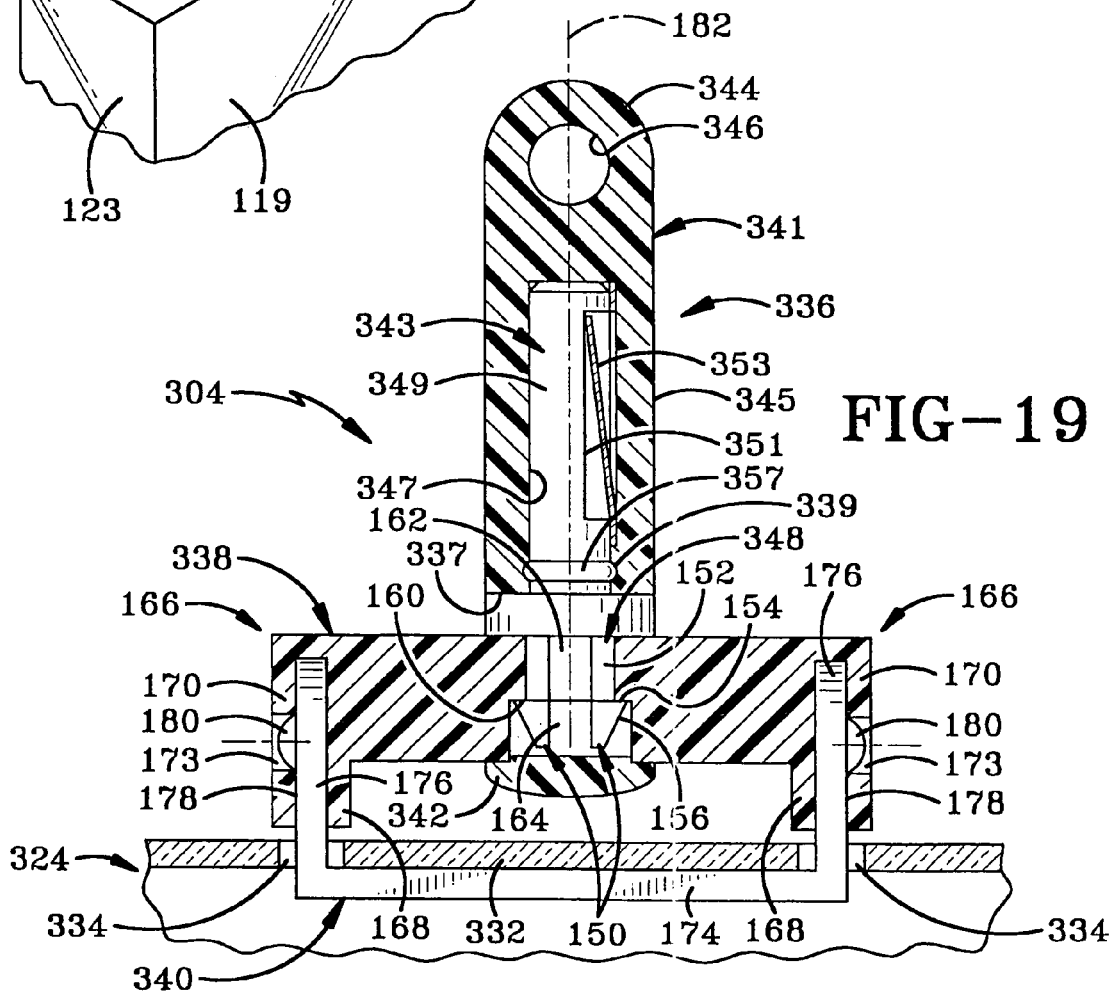
FIG. 19 is a partial sectional view showing the display case and hanging assembly including a locking device in a locked position.

FIG. 15 shows display case 206 rotated upwardly towards outer end 216 of rod assembly 202. FIG. 15 also shows display case 206 in an open position. Display case 206 differs from case 106 in that display case 206 includes an inner shell 228 and an outer shell 229 that pivot with respect to one another about axis 235 with the use of hinge pins 230. FIG. 15 further shows item of merchandise 222 being removed from case 206. Inner shell 228 and outer shell 229 may be locked to one another in a closed position (FIG. 14) to prevent unauthorized removal of merchandise 222.

Thus, merchandise display system 200 provides a secure system by which items of merchandise 222 are encased in display cases 206 which have lockable inner and outer shells 228 and 229 to prevent merchandise 222 from being removed without authorization. Further, system 200 prevents unauthorized removal from lower rod 214 of hanging assembly 204 and display case 206 hanging therefrom. System 200 also allows the consumer to maneuver display case 206 with item of merchandise 222 therein to easily view merchandise 222 without the need for removal from rod 214. Thus, system 200 provides security for the seller as well as convenient review of merchandise 222 for the consumer.

A third embodiment of the merchandise display system of the present invention is indicated generally at 300 and is shown in FIGS. 16–23. Display system 300 includes a lockable rod assembly 302, a hanging assembly 304 which hangs from rod assembly 302 and a lockable merchandise display case 306 which is connected to and hangs from hanging assembly 304. Hanging assembly 304 is configured to allow display case 306 and merchandise 322 within to pivot and swivel in a manner such that the consumer can easily handle case 306 and view merchandise 322 within case 306.

Lockable rod assembly 302 includes an inner end 308 which is lockable to a peg board 310 or the like. Rod assembly 302 includes lockable base assembly 309 adjacent inner end 308. Rod assembly 302 further includes an upper rod 312 and a lower rod 314 which are substantially parallel and extend outwardly and horizontally from inner end 308 to an outer end 316. Inner rod assembly 302 further includes a locking mechanism 318 adjacent outer end 316, the locking mechanism locking onto rod 314 to prevent removal of merchandise 322 from lower rod 314. Rod assembly 302 is the same as assemblies 102 and 202.

Display case 306 includes an interior chamber 320 in which is inserted an item of merchandise 322. Display case 306 includes a front side 319, a back side 321, and a pair of lateral sides 323. Display case 306 further includes an upper end 324 and a lower end 326. A lockable door 328 is hingedly connected to case 306 by hinge 330. Case 306 also includes an upper wall 332 adjacent upper end 324 in opposed relation to door 328. Upper wall 332 defines a pair of slots 334 for receiving a portion of hanging assembly 304 as described below.

Figure 22:
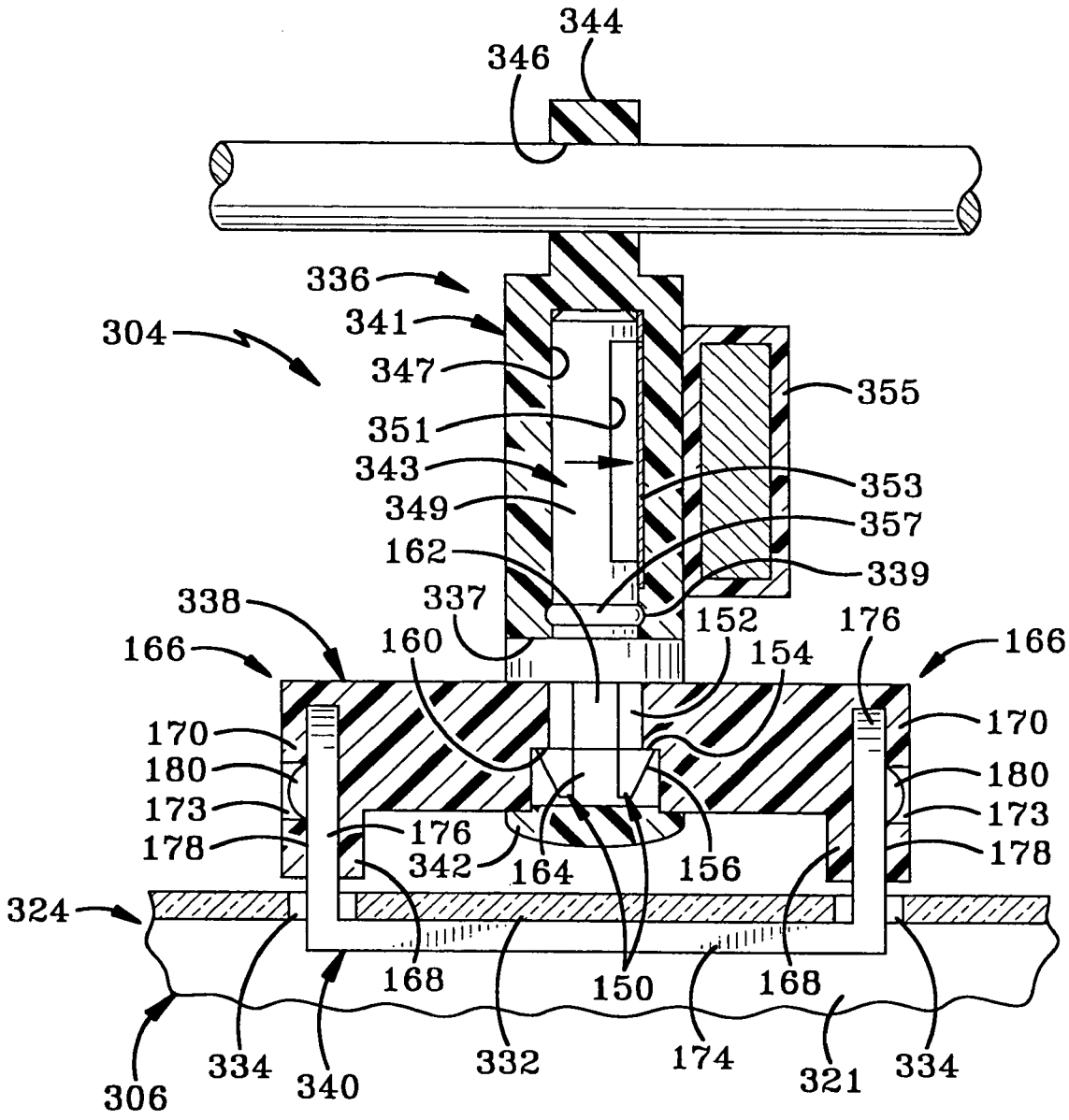
FIG. 22 is a fragmentary partial sectional view of the third embodiment showing the rod assembly, display case and hanging assembly including a magnetic key and the locking device in an unlocked position.

In accordance with the present invention, hanging assembly 304 includes a hanging member 336, a swivel member 338, a U-shaped lower member 340 and a cap 342. Hanging assembly 304 allows case 306 to be removed from rod assembly 302 when a lock is unlocked. The key that unlocks this lock may be the same key that unlocks rod assembly 302. Hanging member 336 includes an upper member 341 and a lower member 343. Upper member 341 of hanging member 336 has an upper portion 344 which defines a hole 346 for receiving lower rod 314. A cylinder 345 defining an interior chamber 347 (FIG. 22) extends downwardly from upper portion 344 of upper member 341. Cylinder 345 has a lower end 337 and defines an annular recessed area 339 adjacent lower end 337. Recessed area 339 is part of interior chamber 347. Lower member 343 includes a lower portion 348 and a generally cylindrical rod 349 extending upwardly therefrom. Rod 349 defines a notch 351 extending lengthwise on one side of rod 349. An annular flange 357 complementary to recessed area 339 extends radially outward from rod 349 below notch 351. A plate spring 353 is disposed within interior chamber 347 of cylinder 345 to one side of chamber 347. In an assembled form, rod 349 of lower member 343 is disposed within interior chamber 347 of cylinder 345 with annular flange 357 disposed within recessed area 339 in a snap-fit engagement. In a locked position (FIG. 19), plate spring 353 is partially disposed within notch 351 and engages an upper portion of rod 349. FIG. 22 shows hanging assembly 304 in an unlocked position wherein a magnetic key 355 attracts the portion of plate spring 353 which was disposed within notch 351 in the locked position so that plate spring 353 lies flat outside the bounds of notch 351.

Figure 20:
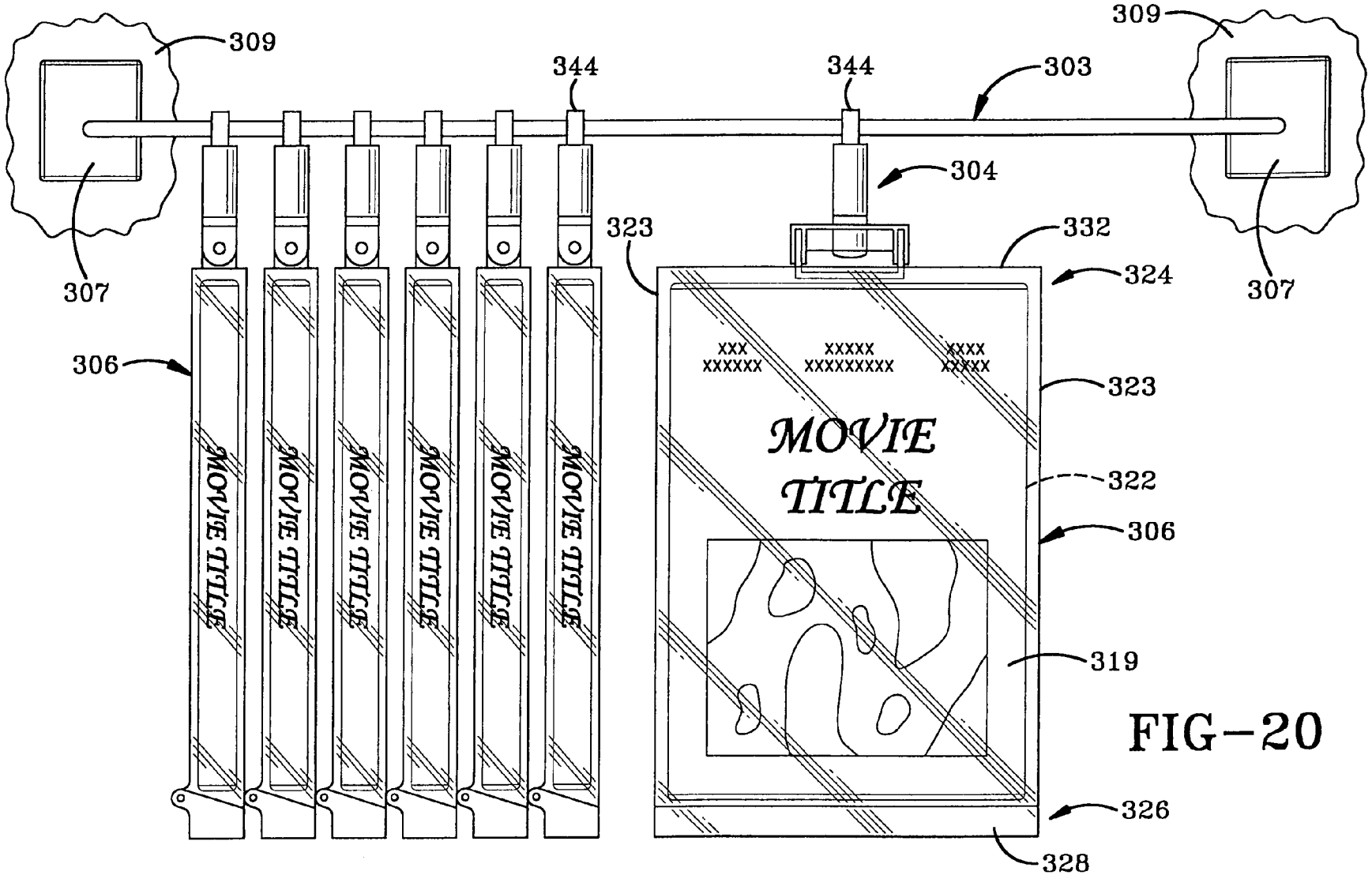
FIG. 20 is a side elevational view of the third embodiment including an alternate rod assembly and one display case in a rotated position.
Figure 21:
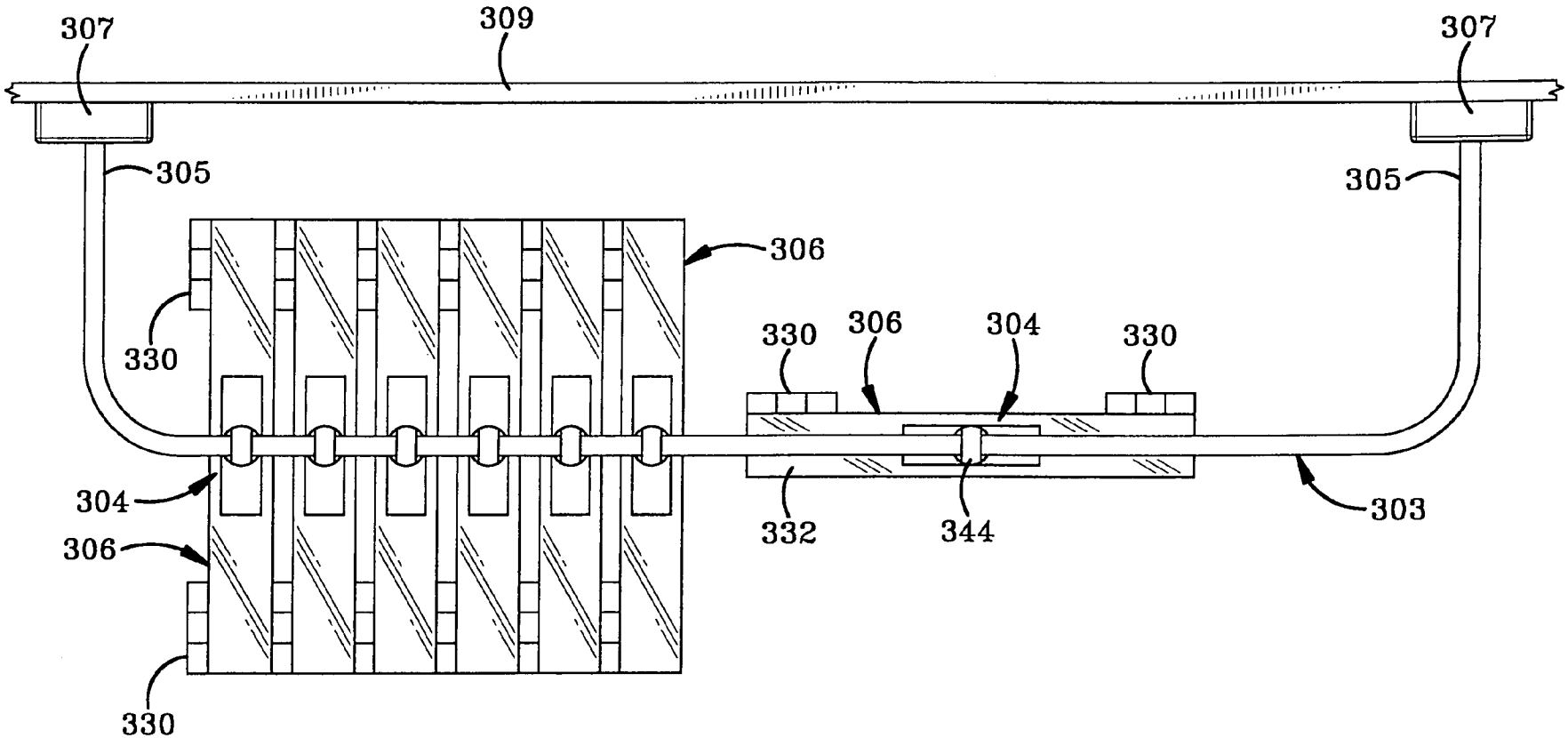
FIG. 21 is a top plan view of the third embodiment as shown in FIG. 20.

Swivel member 338, cap 342 and U-shaped lower member 340 are identical to their counterparts in the first embodiment as described above. However, in accordance with the present invention, FIGS. 20 and 21 show an alternate embodiment of a lockable rod assembly 303. Rod assembly 303 includes a pair of ends 305 which may be fixed to a display or which can be locked in a lockable base assembly 307 connected to a peg board 309 or the like. At least one base assembly 307 is configured to allow upper portions 344 to be placed on the rod when assembly 307 is unlocked.

In operation, hanging assembly 304 functions in the same manner as hanging assembly 104 of the first embodiment, except for the removably connected upper and lower members 341 and 343 of hanging member 336 and the locking mechanism created by upper member 341, lower member 343 and plate spring 353. In addition, the maneuverability of display system 300 is altered somewhat by the use of the alternate U-shaped lockable rod assembly 303, as described below.

When rod 349 is disposed in interior chamber 347 with flange 357 forming a snap-fit engagement with recessed area 339, flange 357 supports the lower portions of hanging assembly 304 along with display case 306 and merchandise 322. However, this snap-fit engagement still allows reasonably easy removal of rod 349 from interior chamber 347 when hanging assembly 304 is in the unlocked position.

Figure 23:
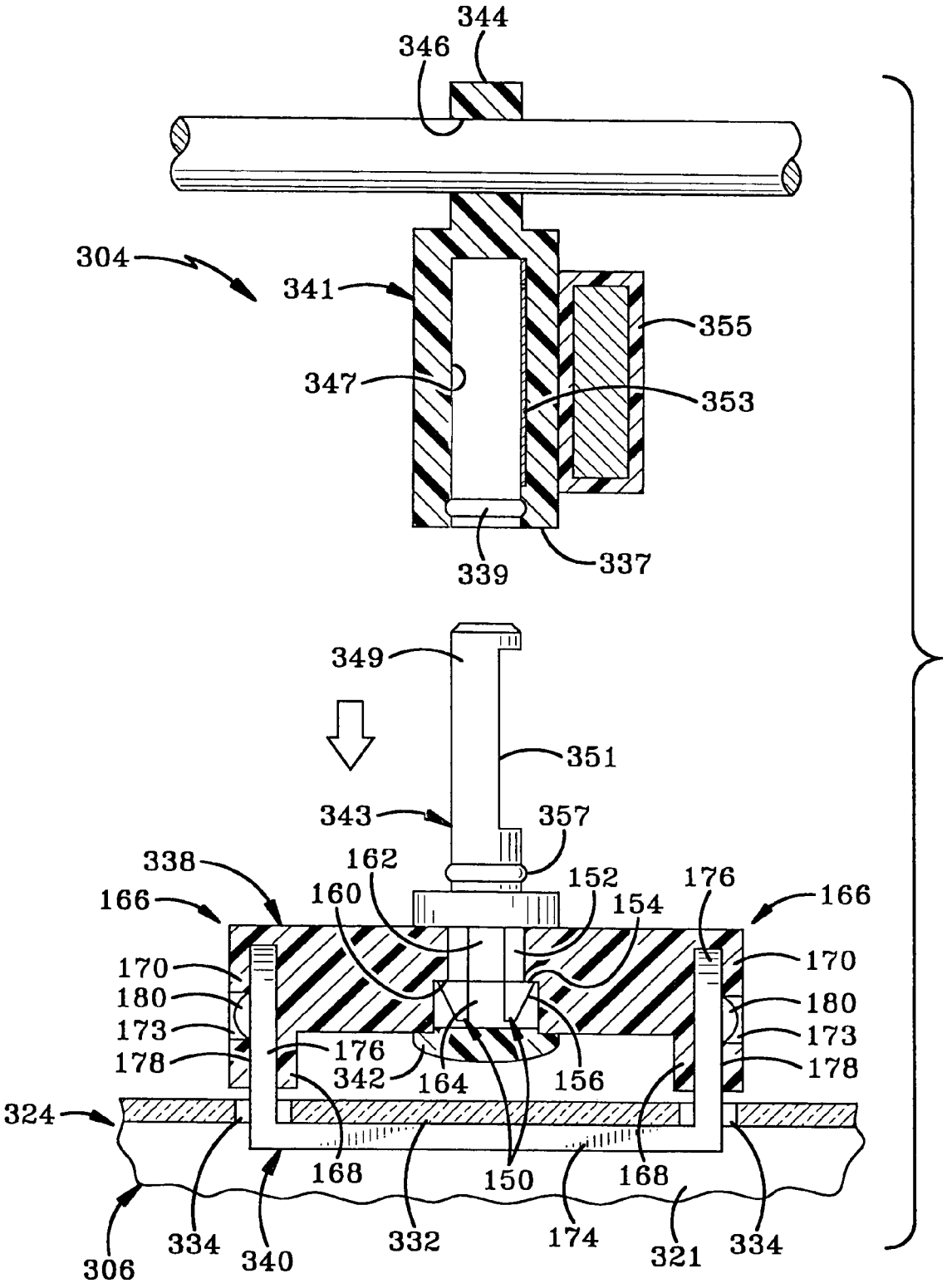
FIG. 23 is a fragmentary exploded partial sectional view of the third embodiment as shown in FIG. 22 wherein the locking device is unlocked and in a released position.
Figure 24:
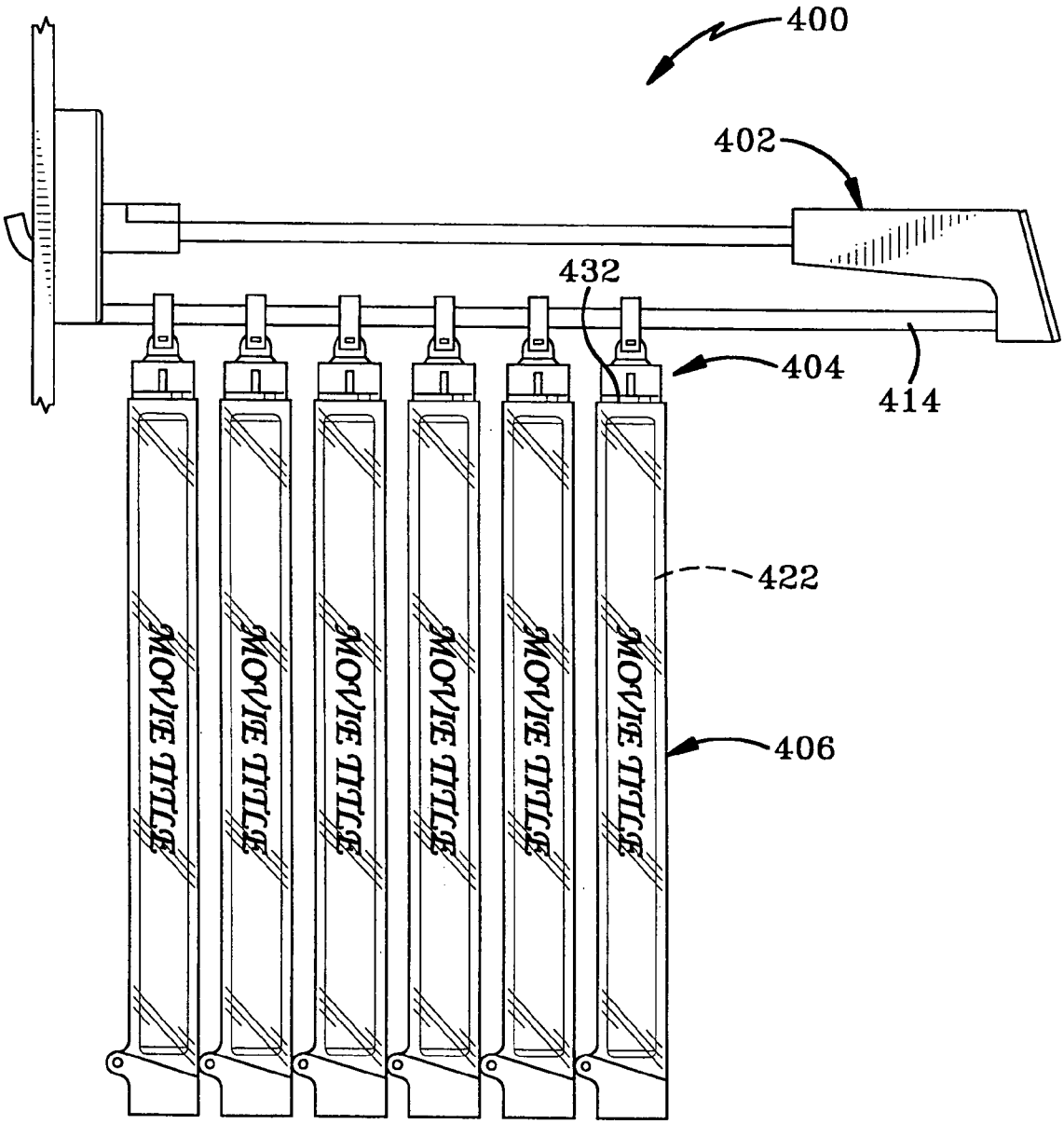
FIG. 24 is a side elevational view of a fourth embodiment of the present invention.
Figure 25:
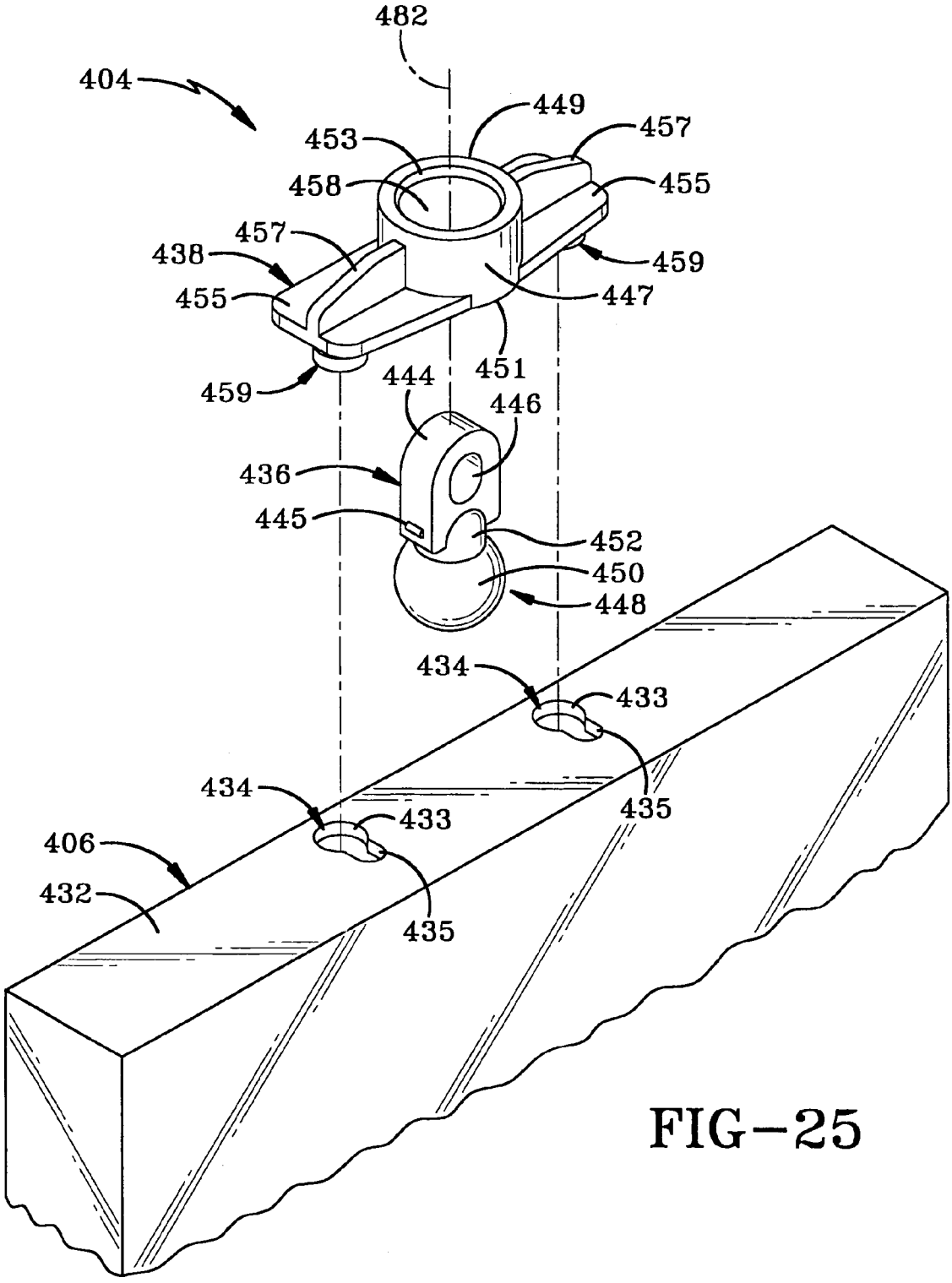
FIG. 25 is a fragmentary exploded perspective view of the fourth embodiment showing the hanging assembly and display case.

The locking mechanism of hanging member 336 functions as follows. Rod 349 is inserted into interior chamber 347 of cylinder 345 so that the inwardly extending portion of plate spring 353 is depressed outwardly until notch 351 aligns with said portion of plate spring 353, thereby allowing said portion of plate spring 353 to move inwardly into notch 351 and engage an upper portion of rod 349, to prevent removal of rod 349 from interior chamber 347 of cylinder 345. To unlock the locking mechanism, magnetic key 355 is placed against cylinder 345 adjacent plate spring 353 to attract the inwardly disposed portion of plate spring 353, thus removing said portion of plate spring 353 from within notch 351, as shown in FIG. 22. Rod 349 may be removed from interior chamber 347, as shown in FIG. 23. This allows the lower portion of hanging assembly 304 to be removed along with display case 306 and item of merchandise 322 as desired. This gives an alternative method of removing display case 306 from rod 314 or rod assembly 303 without having to unlock the rod assembly itself.

As viewed from above, U-shaped lockable rod assembly 303 allows for similar movement as with rod assembly 302, which as noted above, is the same as assemblies 102 and 202. However, the maneuverability of display case 306 hanging from rod assembly 303 is not limited by an upper rod or a locking mechanism at the end of an upper and lower rod as is the case with rod assembly 302. Similar to rod assembly 302, assembly 303 would be limited by any additional display cases 306 hanging from rod assembly 303. However, maneuverability would also be limited by a peg board 309 or the like. Nonetheless, display case 306 is able to rotate in a 360° arc as viewed from above and also may rotate about axis 384 such that it may travel an arc of at least 180° in a direction between a pair of ends 305 of rod assembly 303.

Thus, merchandise display system 300 provides a secure system by which items of merchandise 322 are encased in display cases 306 which have lockable doors 328 to prevent merchandise 322 from being removed without authorization. Further, system 300 prevents unauthorized removal from lower rod 314 of hanging assembly 304 and display case 306 hanging therefrom. Assembly 300 also allows the consumer to maneuver display case 306 with item of merchandise 322 therein to easily view merchandise 322 without the need for removal from rod 314. Thus, system 300 provides security for the seller as well as convenient review of merchandise 322 for the consumer.

A fourth embodiment of the merchandise display system of the present invention is indicated generally at 400 and is shown in FIGS. 24–30. Display system 400 includes a lockable rod assembly 402, a hanging assembly 404 which hangs from rod assembly 402 and a lockable merchandise display case 406 which is connected to and hangs from hanging assembly 404. Hanging assembly 404 is configured to allow display case 406 and merchandise 422 within to pivot and swivel in a manner such that the consumer can easily handle case 406 and view merchandise 422 within case 406.

Lockable rod assembly 402 is the same as rod assembly 102 and functions in the same manner. In addition, display case 406 is similar to display case 106 except that upper wall 432, instead of defining a pair of slots, defines a pair of holes 434. As viewed from above, holes 434 are substantially shaped like a cross-section of a light bulb wherein there is a circular portion 433 with a U-shaped portion 435 extending outwardly therefrom.

In accordance with the present invention, hanging assembly 404 includes a hanging member 436 and a swivel member 438. Hanging member 436 has an upper portion 444 which defines a hole 446 for receiving lower rod 414. Upper portion 444 also includes a pair of ears 445 extending outwardly therefrom. Hanging member 436 further includes a lower portion 448 which includes a downwardly extending neck 452 from which extends downwardly a spherical member 450.

Figure 26:
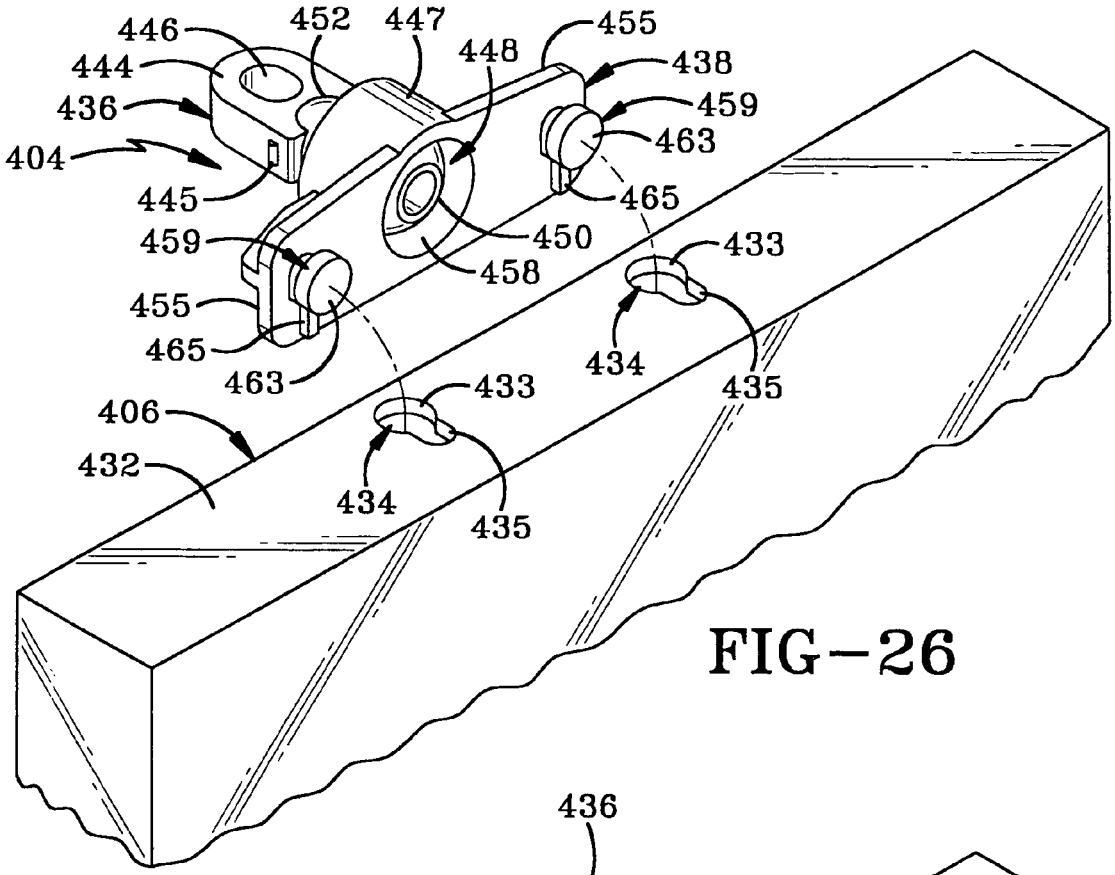
FIG. 26 is a fragmentary partially exploded perspective view of the fourth embodiment showing the hanging mechanism intact and showing how the locking tabs of the mechanism insert into the slots in the display case.
Figure 29:
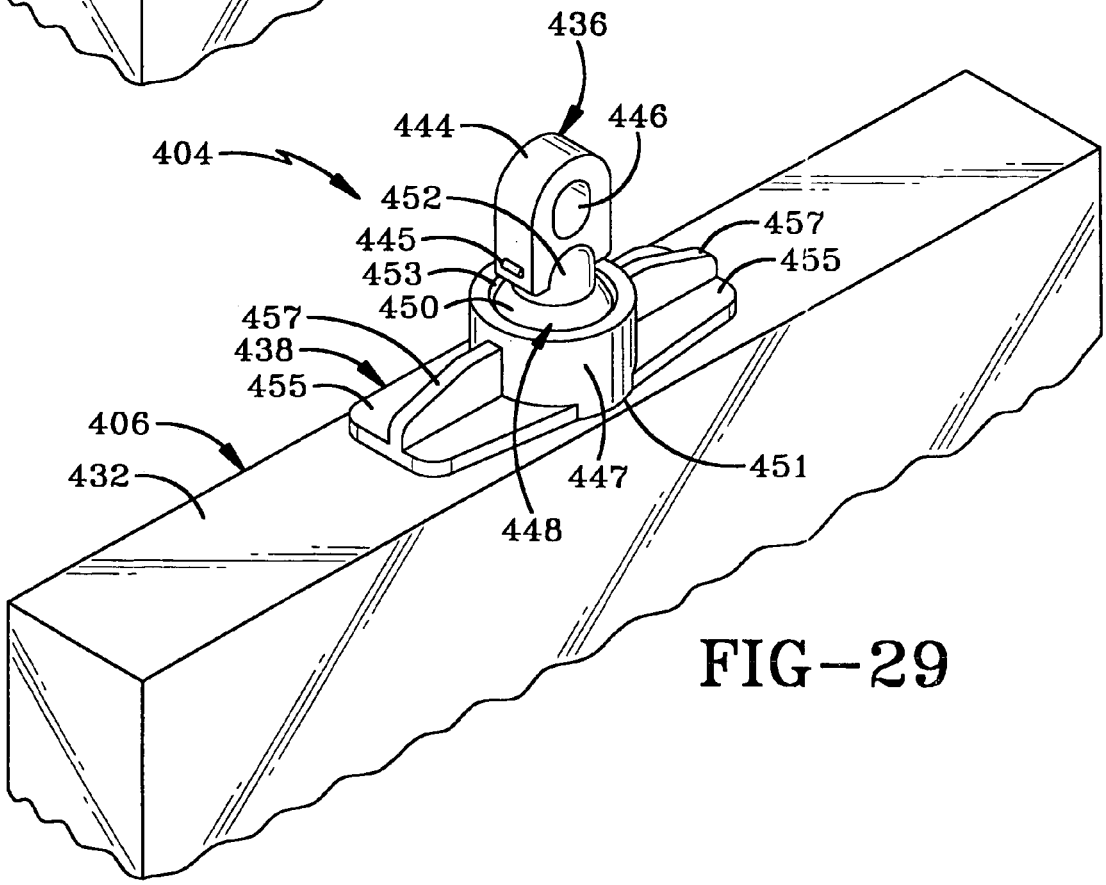
FIG. 29 is a fragmentary perspective view similar to FIG. 26 showing the hanging assembly connected to the display case.
Figure 27:
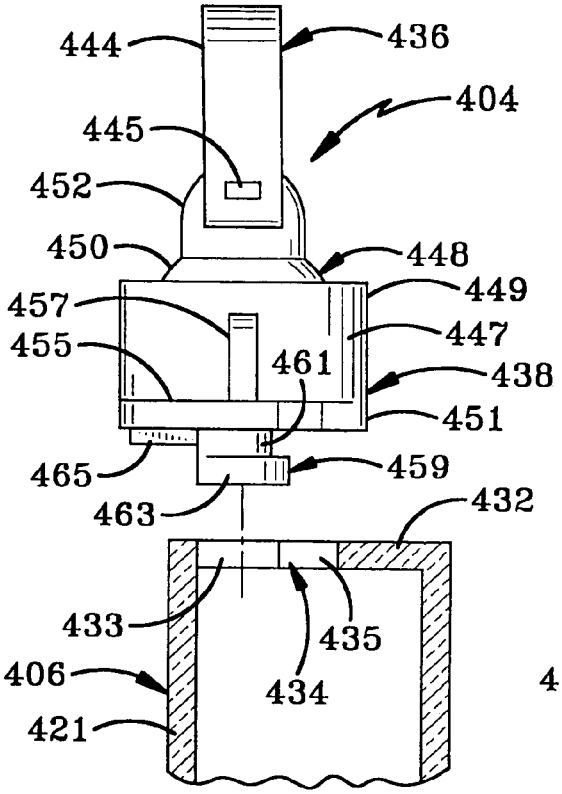
FIG. 27 is a partial sectional view of the fourth embodiment as viewed from the side showing the hanging assembly in a position prior to being inserted into the slots in the display case.
Figure 28:
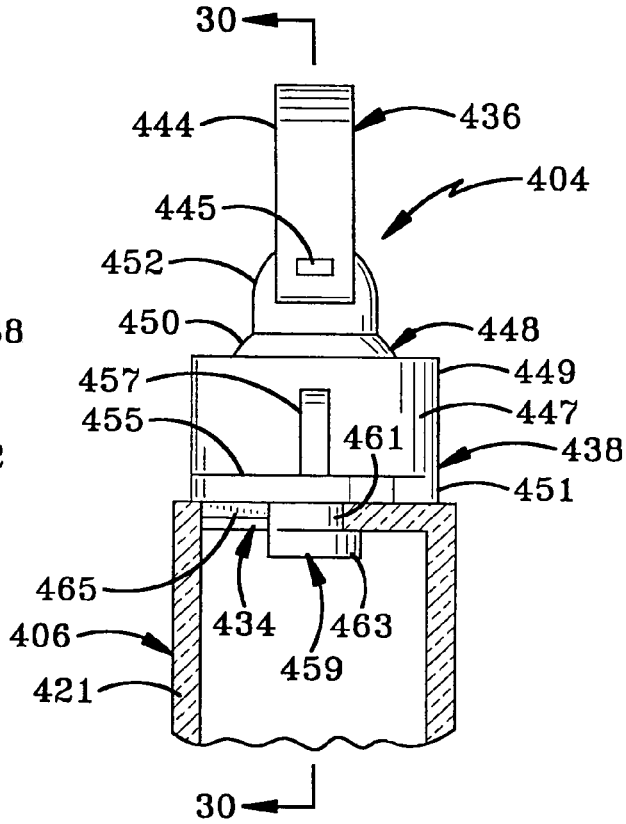
FIG. 28 is a view similar to FIG. 27 with the hanging assembly connected to the display case.
Figure 30:
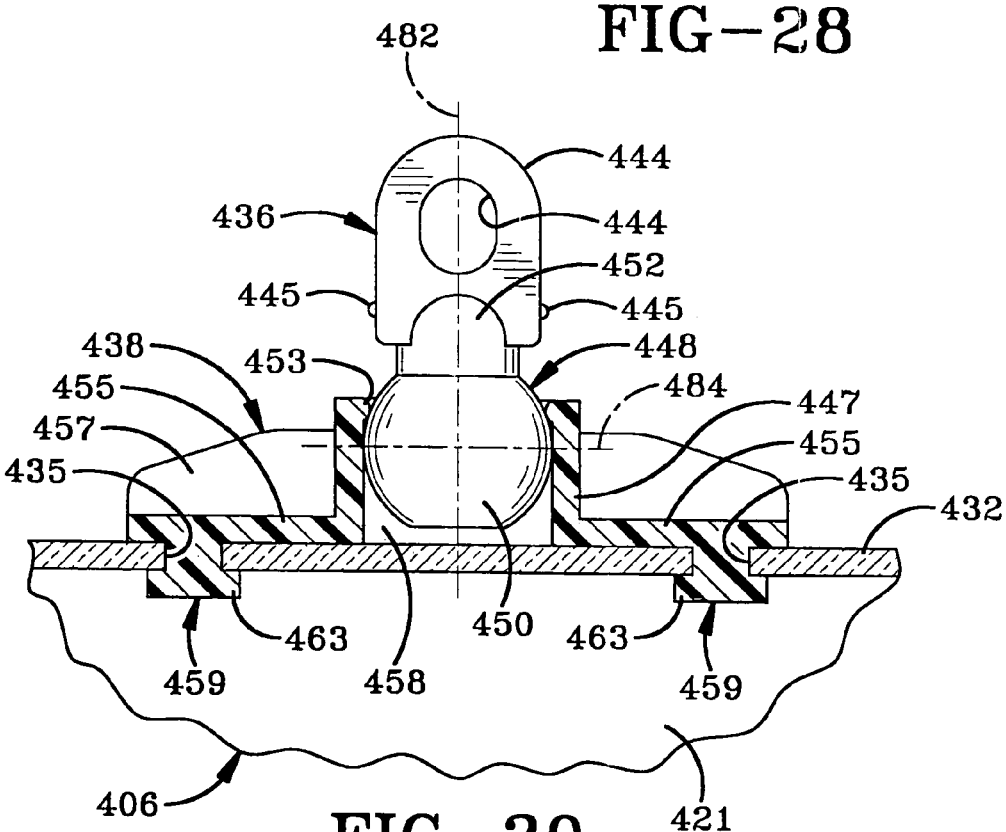
FIG. 30 is a fragmentary partial sectional view of the fourth embodiment taken on line 30—30 of FIG. 28.

Swivel member 438 defines a vertical cylindrical hole 458 for receiving spherical member 450 of hanging member 446. Hole 458 is bounded by cylinder 447 having an upper end 449 and a lower end 451. Hole 458 is narrowed adjacent upper end 449 of cylinder 447 by inwardly extending annular flange 453. A pair of wings 455 extend horizontally outwardly from cylinder 447 adjacent lower end 451. A pair of ribs 457 extend outwardly in a vertical plane from cylinder 447 and upwardly from respective wings 455. A pair of spaced locking tabs 459 extend downwardly from respective wings 455. As shown in FIGS. 26–28, each locking tab includes a neck 461 extending downwardly from respective wing 455 and a substantially circular foot 463 connected to neck 461 there below. In relation to neck 461, foot 463 extends toward front side 419 of display case 406 when swivel member 438 is connected thereto, and foot 463 also extends laterally toward lateral sides 423 of case 406. Each locking tab 459 also includes a finger which extends downwardly from respective wing 455 and outwardly from respective neck 461 away from the forward extension of foot 463 such that finger 465 extends toward back side 421 of display case 406 when swivel member 438 is installed thereon.

In assembling hanging assembly 404, upper portion 444 of hanging member 436 is inserted upwardly through hole 458 of swivel member 438 so that upper portion 444 is disposed above cylinder 447 and spherical member 450 rests against annular flange 453. The distance defined by the outermost portions of ears 445 is larger than the diameter defined by the innermost portion of annular flange 453. Ears 455 nonetheless slide past flange 453 so that during assembly ears 445 prevent hanging member 436 from slipping back through hole 458 before hanging member 436 is hung on lower rod 414 of rod assembly 402. The diameter of spherical member 450 is wide enough to prevent spherical member 450 from being pushed upwardly beyond annular flange 453, but is small enough to allow easy movement within hole 458 of cylinder 447.

Locking tabs 459 form a locking engagement with display case 406 when inserted properly into holes 434. FIGS. 26–28 indicate how locking tabs 459 are inserted into holes 434. First, each foot 463 is aligned with and inserted into a respective circular portion 433 of hole 434. Each foot 463 is then slid toward front side 419 of case 406 so that each neck 461 fits into a respective U-shaped portion 435. Simultaneously, each finger 465 slides along upper wall 432 until it snaps downwardly into a respective circular portion 433 of hole 434. Once in this configuration, as shown in FIG. 28, locking tabs 459 form a locking engagement with case 406.

In operation, hanging assembly 404 allows display case 406 to be maneuvered easily in a great variety of positions so that a consumer can easily view all sides of merchandise 422 encased therein. Hanging assembly 104 functions somewhat similarly to the previous embodiments in that it allows for substantially the same type of movement. Particularly, assembly 404 and case 406 may be rotated 360° about vertical axis 482. In addition, the ball and socket configuration of assembly 404 allows swivel member 438 and display case 406 to pivot upwardly in any direction from axis 482. While this upward movement is multi-directional, it is more limited than in the previous embodiments. The limiting factor is an interference between annular flange 453 or upper end 449 of cylinder 447 and neck 452 of hanging member 436 as swivel member 438 and display case 406 are moved in an upward direction. Nonetheless, with the additional mobility provided by rotational movement of hanging member 436 about lower rod 414, display case 406 may be maneuvered sufficiently to view any side of display case 406 without difficulty.

Thus, merchandise display system 400 provides a secure system by which items of merchandise 422 are encased in display cases 406 which have lockable doors 428 to prevent merchandise 422 from being removed without authorization. Further, system 400 prevents unauthorized removal from lower rod 414 of hanging assembly 404 and display case 406 hanging therefrom. System 400 also allows the consumer to maneuver display case 406 with item of merchandise 422 therein to easily view merchandise 422 without the need for removal from rod 414. Thus, system 400 provides security for the seller as well as convenient review of merchandise 422 for the consumer.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A merchandise display system comprising:

a swivel assembly including first and second members;

a display case adapted to carry an item of merchandise;

a display structure which includes a first rod to which the swivel assembly is adapted to be connected and a support structure to which the first rod is connected:

wherein the first rod has a first end connected to the support structure and a second end extending outwardly from the support structure: and an end assembly is selectively lockable adiacent the second end of the first rod to selectively prevent the removal of the swivel assembly and display case from the first rod:

wherein the first member is adapted to mount on the display structure;

wherein the second member is rigidly connected to the display case;

wherein one of the first and second members includes a generally spherical member;

wherein the other of the first and second members comprises a cylinder defining a socket in which the spherical member is disposed to connect the first and second members to one another; the cylinder extending circumferentially in a continuous manner all the way around the socket so that the spherical member is non-removably disposed in the socket when the second member is connected to the display case;

wherein the second member and display case are rotatable relative to the first member about a substantially vertical axis through a 360-degree arc when in a hanging position adapted to mount the first member on the display structure; and wherein the second member and display case are tiltable relative to the first member in any direction with respect to the axis.

2. The system of claim 1 wherein the second member is non-removably connected to the display case by a snap fit engagement.

3. The system of claim 1 wherein the display case is selectively lockable.

4. The system of claim 1 wherein a continuous annular flange is connected to and extends inwardly from the cylinder to retain the spherical member within the socket; and wherein the spherical member slidably abuts the annular flange during relative movement therebetween.

5. The system of claim 4 wherein the cylinder has first and second opposed ends; and wherein the continuous annular flange is disposed closely adjacent one of the ends.

6. The system of claim 4 wherein the cylinder has an upper end which defines an entrance opening of the socket; wherein a portion of the first member extends upwardly through the entrance opening; and wherein the continuous annular flange is disposed closely adjacent the upper end.

7. The system of claim 4 wherein the spherical member and the annular flange engage one another via a continuous circular interface therebetween.

8. The system of claim 1 wherein the second member includes the cylinder; wherein the spherical member is disposed closely adjacent the display case.

9. The system of claim 1 wherein the cylinder has upper and lower cylinder has upper and lower opposed ends; wherein the socket is a through bore extending from the upper end to the lower end; and wherein the spherical member is disposed closely adjacent each of the upper and lower ends.

10. The system of claim 1 wherein the system is free of a spring member for biasing the spherical member within the socket.

11. A merchandise display system comprising:

a swivel assembly including first and second members;

a display case adapted to carry an item of merchandise:

wherein the first member is adapted to mount on a display structure:

wherein the second member is rigidly connected to the display case:

wherein one of the first and second members includes a generally spherical member;

wherein the other of the first and second members comprises a cylinder defining a socket in which the spherical member is disposed to connect the first and second members to one another: the cylinder extending circumferentially in a continuous manner all the way around the socket so that the spherical member is non-removably disposed in the socket when the second member is connected to the display case:

wherein the second member and display case are rotatable relative to the first member about a substantially vertical axis through a 360-degree arc when in a hanging position adapted to mount the first member on the display structure:

wherein the second member and display case are tiltable relative to the first member in any direction with respect to the axis: and wherein the second member is non-removably connected to the display case by a snap fit engagement: wherein one of the second member and the display case defines at least one hole and the other of the second member and the display case includes at least one locking tab insertable in the at least one hole to provide the snap fit engagement; the hole having a larger portion and a smaller portion in communication with the larger portion; the locking tab including a neck portion and a foot portion extending from the neck portion so that the neck portion is disposed in the smaller portion of the hole and the foot portion prevents removal of the locking tab from the hole by an interference with the one of the second member and the display case defining the hole.

12. The system of claim 11 wherein the neck portion is slidably received within the smaller portion of the hole and wherein the locking tab further includes a stop portion disposed within the larger portion of the hole to prevent the neck from sliding out of the smaller portion of the hole.

13. The system of claim 6 further including the display structure; wherein the display structure includes a first rod to which the swivel assembly is adapted to be connected.

14. The system of claim 13 wherein the display structure includes a support structure to which the first rod is connected.

15. The system of claim 14 wherein the first rod has a first end connected to the support structure and a second end extending outwardly from the support structure; and an end assembly is selectively lockable adjacent the second end of the first rod to selectively prevent the removal of the swivel assembly and display case from the first rod.

16. The system of claim 11 further including the display structure; wherein the display structure includes a support rod; and wherein the first member defines a through opening for receiving the rod therein whereby the first member is slidably connected to the rod.

17. A merchandise display system comprising:

a swivel assembly including first and second members:

a display case adapted to carry an item of merchandise:

a display structure which includes a support rod:

wherein the first member defines a through opening for receiving the rod wherein whereby the first member is slidably connected to the rod:

wherein the second member is rigidly connected to the display case:

wherein one of the first and second members includes a generally spherical member;

wherein the other of the first and second members comprises a cylinder defining a socket in which the spherical member is disposed to connect the first and second members to one another: the cylinder extending circumferentially in a continuous manner all the way around the socket so that the spherical member is non-removably disposed in the socket when the second member is connected to the display case:

wherein the second member and display case are rotatable relative to the first member about a substantially vertical axis throuah a 360-degree arc when in a hanging position adapted to mount the first member on the display structure:

wherein the second member and display case are tiltable relative to the first member in any direction with respect to the axis:

wherein the display case defines a pair of spaced holes; wherein the second member includes a pair of spaced locking tabs which are respectively received in the spaced holes via a non-removable snap fit engagement to rigidly connect the second member to the display case; and wherein the swivel assembly consists of the first and second members.

18. A merchandise display system comprising:

a swivel assembly including first and second members:

a display case adapted to carry an item of merchandise:

wherein the first member is adapted to mount on a display structure:

wherein the second member is rigidly connected to the display case:

wherein one of the first and second members includes a generally spherical member;

wherein the other of the first and second members comprises a cylinder defining a socket in which the spherical member is disposed to connect the first and second members to one another; the cylinder extending circumferentially in a continuous manner all the way around the socket so that the spherical member is non-removably disposed in the socket when the second member is connected to the display case;

wherein the second member and display case are rotatable relative to the first member about a substantially vertical axis through a 360-degree arc when in a hanging position adapted to mount the first member on the display structure:

wherein the second member and display case are tiltable relative to the first member in any direction with respect to the axis:

wherein the second member is non-removably connected to the display case by a snap fit engagement;

wherein the display case has inner and outer surfaces;

wherein the display case defines a pair of spaced holes each extending from the inner to the outer surface;

wherein the second member includes the cylinder and first and second wings which are connected to and extend outwardly from the cylinder in generally opposite directions from one another; wherein the first and second wings are substantially flat and oriented substantially horizontally;

wherein the second member includes first and second ribs which are connected to and extend outwardly from the cylinder and upwardly from the first and second wings respectively; and wherein the second member includes a pair of spaced locking tabs which are connected to and extend downwardly from the respective wings and are respectively received in the spaced holes of the display case to provide the snap fit engagement.

19. A merchandise display system comprising:

a swivel assembly which includes first and second members:

wherein the first member is adapted to mount on a display structure:

wherein the second member is rotatable with respect to the first member about a first axis and rotatable with respect to the first member about a second axis substantially perpendicular to the first axis:

a display case adapted to carry an item of merchandise:

wherein the second member and display case are non-removably connected to one another by a snap fit engagement so that the display case is rotatable with the second member about the first and second axes:

wherein the display case has inner and outer surfaces;

wherein the display case defines a pair of spaced holes each extending from the inner to the outer surface;

wherein each hole includes a larger portion and a smaller portion in communication with the larger portion;

wherein the second member includes a body having a lower surface and a pair of spaced locking tabs which are respectively received in the spaced holes to provide the snap fit engagement;

wherein each locking tab includes a neck, a foot and a finger;

wherein each neck is connected to and extends downwardly from the lower surface of the body;

wherein each foot includes a first portion which is connected to and extends outwardly from the respective neck and is spaced downwardly from the lower surface of the body;

wherein each finger is disposed adjacent the respective neck and is connected to and extends downwardly from the lower surface of the body a shorter distance than does the respective foot;

wherein each finger is disposed in the larger portion of the respective hole;

wherein each neck is disposed in the smaller portion of the respective hole; and wherein the first portion of each foot is disposed closely adjacent the inner surface of the display case with a respective portion of the display case disposed directly between the lower surface of the body and the respective first portion.

20. The system of claim 19 wherein the neck is slidable in a first direction during assembly into the smaller portion of the hole; and wherein the finger engages the display case to prevent slidable movement of the respective locking tab in a second direction opposite the first direction.

21. The system of claim 19 wherein each foot includes a second portion which is connected to and extends outwardly from the respective neck in a direction generally opposite from the respective first portion and which is spaced downwardly from the lower surface of the body; and wherein each second portion is disposed closely adjacent the inner surface of the display case with a respective portion of the display case disposed directly between the lower surface of the body and the respective second portion.

22. A merchandise display system comprising:

a swivel assembly which includes first and second members;

wherein the first member is adapted to mount on a display structure;

wherein the second member is rotatable with respect to the first member about a first axis and rotatable with respect to the first member about a second axis substantially perpendicular to the first axis;

a display case adapted to carry an item of merchandise;

wherein the second member and display case are non-removably connected to one another by a snap fit engagement so that the display case is rotatable with the second member about the first and second axes;

wherein the display case has inner and outer surfaces;

wherein the display case defines a pair of spaced holes each extending from the inner to the outer surface;

wherein the second member includes a pair of spaced locking tabs which are respectively received in the spaced holes to provide the snap fit engagement;

wherein during assembly the second member is movable from an unassembled position to an assembled position in which the swivel assembly is connected to the display case via the snap fit engagement;

wherein each locking tab includes first, second and third portions;

wherein during assembly each locking tab is slidable laterally in a first direction with the respective first portion slidably engaging the outer surface of the display case, the respective second portion sliding within the respective hole and the respective third portion slidably engaging the inner surface of the display case to a position from which the respective first portion snaps downwardly into the respective hole to move the second member to the assembled position; and wherein in the assembled position each first portion engages the display case to prevent slidable movement of the respective locking tab in a second direction opposite the first direction.

23. The system of claim 22 wherein each hole includes a larger portion and a smaller portion in communication with the larger portion; wherein during assembly each third portion is insertable downwardly into the respective larger portion; wherein during assembly each second portion is slidable laterally in the first direction from within the respective larger portion into the respective smaller portion; and wherein during assembly each first portion snaps downwardly into the respective larger portion.

* * * * *